US010589756B2

(12) United States Patent
Zarafshan

(10) Patent No.: US 10,589,756 B2
(45) Date of Patent: Mar. 17, 2020

(54) MODULAR ENCLOSED TRANSPORTATION STRUCTURE AND INTEGRATED TRACK ASSEMBLY

(71) Applicant: Hyperloop Technologies, Inc., Los Angeles, CA (US)

(72) Inventor: Ali Zarafshan, Los Angeles, CA (US)

(73) Assignee: HYPERLOOP TECHNOLOGIES, INC., Los Angeles, CA (US)

( * ) Notice: Subject to any disclaimer, the term of this patent is extended or adjusted under 35 U.S.C. 154(b) by 210 days.

(21) Appl. No.: 15/820,663

(22) Filed: Nov. 22, 2017

(65) Prior Publication Data

US 2018/0141571 A1 May 24, 2018

Related U.S. Application Data

(60) Provisional application No. 62/425,749, filed on Nov. 23, 2016, provisional application No. 62/471,740, filed on Mar. 15, 2017.

(51) Int. Cl.

| | |
|---|---|
| ***E01B 29/32*** | (2006.01) |
| ***E01B 2/00*** | (2006.01) |
| ***E01B 25/00*** | (2006.01) |
| ***E01B 25/30*** | (2006.01) |
| ***B61B 13/10*** | (2006.01) |
| ***B61B 13/08*** | (2006.01) |

(52) U.S. Cl.

CPC ..... *B61B 13/10* (2013.01); *B61B 13/08* (2013.01); *E01B 2/00* (2013.01); *E01B 25/00* (2013.01); *E01B 25/30* (2013.01); *E01B 29/32* (2013.01)

(58) Field of Classification Search

CPC ..... B61B 13/00; B61B 13/08; B61B 13/10; B60L 13/00; B60V 3/04

See application file for complete search history.

(56) References Cited

U.S. PATENT DOCUMENTS

| | | | | | |
|---|---|---|---|---|---|
| 3,443,524 | A * | 5/1969 | Schneider | B60V 3/04 | 104/23.2 |
| 3,630,153 | A * | 12/1971 | Guimarin | B61B 13/10 | 104/138.1 |
| 4,657,435 | A * | 4/1987 | Chang | E02D 29/063 | 405/136 |
| 5,092,710 | A * | 3/1992 | Matiere | E03F 3/04 | 138/105 |
| 5,460,098 | A * | 10/1995 | Jackson | B60V 3/04 | 104/124 |
| 2018/0162227 | A1* | 6/2018 | Roodenburg | A63G 7/00 | |

OTHER PUBLICATIONS

International Search Report and Written Opinion in counterpart application No. PCT/US2017/063071, dated Feb. 5, 2018.

* cited by examiner

*Primary Examiner* — Jason C Smith

(74) *Attorney, Agent, or Firm* — Greenblum & Bernstein, P.L.C.

(57) ABSTRACT

A modular structure, configured to be connectable with a plurality of modular structures to form an enclosed transportation path, each modular structure including a bottom element structured and arranged to provide a track support surface and a plurality of upper element attachment structures, and an upper element configured to attach to the bottom element at the plurality of upper element attachment structures, wherein the upper element is structured to sealingly engage with the lower element.

24 Claims, 18 Drawing Sheets

MODULAR ENCLOSED TRANSPORTATION STRUCTURE AND INTEGRATED TRACK ASSEMBLY

CROSS-REFERENCE TO RELATED APPLICATIONS

The present application claims the benefit of U.S. Provisional Application No. 62/425,749, filed Nov. 23, 2016, and U.S. Provisional Application No. 62/471,740, filed Mar. 15, 2017, the contents of which are expressly incorporated herein by reference in their entireties.

BACKGROUND OF THE DISCLOSURE

1. Field of the Disclosure

The present disclosure relates to an enclosed high-speed transportation system, and more specifically, to a modular enclosed "tube" transportation structure and integrated tube track assembly for a high-speed transportation system.

2. Background of the Disclosure

Superstructure tube transportation systems may include solid cylindrical tubes assembled on sliding connections (e.g., at an interface with respective columns or pylons) and connected together to form an enclosed (e.g., low-pressure environment) transportation path environment. A levitation system is installed inside the tube (e.g., in segments) after the tubes have been placed at their positions and connected together. Constructing a transportation system made of traditional cylindrical tube structures, however, has limitations. For example, a tube structure made of steel has several limitations, such as: larger diameter tubes requiring specialized manufacture and a difficult and costly transportation process; and confined space environments (and the increased operational risks that come therewith).

One such limitation, for example, is due to the size of the cylindrical tube itself. Large diameter cylindrical or elliptical tubes can require specialized manufacturing processes (e.g., expensive rolling, welding and milling). Due to these specialized manufacturing processes, there are a limited number of suppliers that manufacture large diameter tubes. This may restrict the locations where a transportation system that utilizes pre-fabricated tubes can feasibly be built.

Additionally, transportation of these large diameter tubes may be problematic due to the size and/or weight of the cylindrical tube section itself. For example, long distance transportation of large tubes may require specialized trucks and saddles. Furthermore, many countries require permits to move large loads and/or present a small number of available routes for transporting the large tubes. In road transport, an oversize (overweight) load is a load that exceeds the standard or ordinary legal size and/or weight limits for a specified portion of road, highway or other transport infrastructure. A vehicle that exceeds the legal dimensions usually requires a special permit, which may require extra fees to be paid in order for the oversize/overweight vehicle to legally travel on the roadways. Roads may need to be blocked during transportation, and transportation of large diameter tubes may require pilot drivers. As such, with a large tube construction, the possible locations for a transportation system may be limited. Even if there is a supplier near a proposed development site so that transportation costs are low, however, the tubes will still present a large cost of the project and a barrier to feasible use (e.g., on a cost basis).

Additionally, enclosed structures, such as cylindrical tubes, present "confined space" environments. Workplaces may contain areas that are considered "confined spaces," because they are large enough for workers to enter and perform certain jobs, have limited or restricted entry and/or exit routes, and are not designed for continuous occupancy. OSHA uses the term "permit-required confined space" (permit space) to describe a confined space that has one or more of the following characteristics: contains or has the potential to contain a hazardous atmosphere; contains material that has the potential to engulf an entrant; has walls or floors that taper into a smaller area, which could trap or asphyxiate an entrant; and/or contains any other recognized safety or health hazard.

Working within confined spaces, such as presented with a tubular structure, can be hazardous (or otherwise dangerous) to employees, which may lead to an increase in insurance and liability costs, increases in operational risks (e.g., accidents, rescue, etc.), and may pose additional health and safety risks. For example, working in confined spaces may require additional training and spotters or observers.

Additionally, the confined space environments of the tubular structures may slow the rate of assembly. These confined space environments of tubular structures present an additional limitation of cylindrical tubular structures.

Also, the tubular transportation system may require inserts as supports, which presents a tolerance issue. Large diameter tubes may also require additional support systems in to maintain their structural strength. Typically, support systems may include inserts that are constructed to fit into the tube. Thus, if the inserts are not constructed perfectly, the inserts will not fit properly into the tube. Such issues present further limitations for cost-effective use of cylindrical tubular structures.

Additionally, due to the circular inner shape of tubular structures, the mounting of levitation and/or guide tracks systems thereto (or therein) imposes significant constrains on construction simplicity, which can slow production rate. For example, the curved mounting surface of the interior of the cylindrical tube imposes significant constrains on construction simplicity. As such, with a tubular construction, track inserts are necessary to provide a track support, which may require a complex extrusion process, and may require painstaking positioning and installation. For example, concrete inserts may require complex forming and/or molding processes. Additionally, the inserts add significant non-structural mass to the system. Inserts also may require curing, un-molding, transportation, positioning, and installation. Furthermore, inserts in the tubular structures may still require post-machining to properly accommodate or house the tracks (e.g., arranged and positioned in an aligned manner). Thus, the circular inner shape of tubular structures presents another obstacle to cost-effective use of cylindrical tubular structures.

Additionally, these limitations, for example, may be due to dis-integrated installation (e.g., separate tube and track installation) that may make installation and/or positioning times unpractical for large-scale deployment. For example, separate installation of track and tube increases installation and positioning times and makes achieving the necessary tolerance a highly impractical task. Moreover, achieving the required tolerance may be a difficult task using standard construction methods.

Furthermore, alignment limitations of large-scale tubular structures (e.g., difficulty of moving and aligning large heavy tubes) may limit employment of the large-scale tubular structures.

Thus, there is a need for an improved structures and manufacturing methods for enclosed tube transportation structures.

SUMMARY OF THE EMBODIMENTS OF THE DISCLOSURE

The novel features which are characteristic of the disclosure, both as to structure and method of operation thereof, together with further aims and advantages thereof, will be understood from the following description, considered in connection with the accompanying drawings, in which embodiments of the disclosure are illustrated by way of example. It is to be expressly understood, however, that the drawings are for the purpose of illustration and description only, and they are not intended as a definition of the limits of the disclosure.

The following detailed description illustrates by way of example, not by way of limitation, the principles of the disclosure. This description will clearly enable one skilled in the art to make and use the disclosure, and describes several embodiments, adaptations, variations, alternatives and uses of the disclosure, including what is presently believed to be the best mode of carrying out the disclosure. It should be understood that the drawings are diagrammatic and schematic representations of exemplary embodiments of the disclosure, and are not limiting of the present disclosure nor are they necessarily drawn to scale.

The present disclosure is related to an enclosed modular structure and a method for constructing the enclosed modular structure. The enclosed modular structure may be capable of sustaining an environment different from that external to the enclosed modular structure.

The enclosed modular structure may include an upper element and a lower element. The upper element may mateably interact with the lower element. The lower element may include at least one shell. For example, two shells of the lower element may be made out of formed steel plates and cast in place concretes segments (e.g., without reinforcement) to provide vertical and lateral stiffness to the structure. The upper element (or dome) may comprise a metal sheet (e.g., a steel or aluminum sheet), a composite material, or any other suitable material (e.g., that meets design requirements).

In accordance with aspects of the disclosure, in an exemplary embodiment, the lower element of the modular structure may be constructed off-site and later transported to where the track is to be built. Due to the shape and size of the lower element of the modular structure, and/or the stackability of the lower element, transportation of the lower element is more efficient than transportation of large diameter cylindrical tubes, which require expensive trucks and/or expensive routes. Additionally, by constructing the lower element at a shop (e.g., fabrication facility) off-site, higher-tolerances can be achieved. Constructing with higher tolerances is important for long-distance tracks where a small error can get multiplied over long distances.

In accordance with further aspects of the disclosure, the upper element may include a sheet (e.g., of metal) that can be shaped on-site or off-site. Once both elements are on-site, the enclosed modular structure may be assembled, for example, by: (1) fixing the upper element to grooves within the lower element and then permanently fixing the enclosed modular structure in the transportation path; or (2) permanently fixing the lower element in the transportation path and then attaching the upper element to the grooves within the lower element (e.g., after the track installation). In accordance with aspects of the disclosure, this process decreases construction risks by eliminating confined spaces.

Aspects of the present disclosure are directed to a modular structure, configured to be connectable with a plurality of modular structures to form an enclosed transportation path. Each modular structure comprises a bottom element structured and arranged to provide a track support surface and a plurality of upper element attachment structures, and an upper element configured to attach to the bottom element at the plurality of upper element attachment structures, wherein the upper element is arranged to sealingly engage with the lower element.

In embodiments, the bottom element comprises a first shell structured and arranged to form an exterior wall of the bottom element, and a second shell structured and arranged to form an interior wall of the enclosed transportation path. The second shell is spaced from the first shell to provide a gap between the first shell and the second shell.

In further embodiments, the bottom element comprises a horizontal portion structured and arranged to provide the track support surface, and two wing portions that respectively project upwardly and outwardly from the horizontal portion.

In additional embodiments, the upper element attachment structures are respectively arranged on the two wing portions.

In yet further embodiments, the gap is constant in the horizontal portion and constant the wing portions.

In some embodiments, the gap is constant in the horizontal portion and varying in the wing portions.

In further embodiments, the modular structure further comprises at least one support material arranged in the gap to secure the first shell to the second shell.

In additional embodiments, the at least one support material arranged in the gap comprises at least two support materials in the gap, and wherein two of the at least two support materials are configured to each provide respective upper element attachment structures.

In yet further embodiments, the plurality of upper element attachment structures comprise a receiving groove in each of the two of the at least two support materials, wherein the receiving grooves are sized to accommodate respective ends of the upper element in a sealingly-engaged manner.

In embodiments, the bottom element comprises a horizontal portion structured and arranged to provide the track support surface, and two wing portions that respectively project upwardly and outwardly from the horizontal portion. The at least one support material additionally comprises at least two support materials formed in the gap at the respective transitions from the horizontal portion to the two wing portions.

In further embodiments, the modular structure further comprises at least one filler material arranged in the gap to define areas for forming the at least one support material.

In additional embodiments, at least one of the first shell and the second shell includes a plurality of posts projecting therefrom and structured and arranged to contact the support material to strengthen a connection between the support material and the first and second shells.

In yet further embodiments, the second shell includes a plurality holes formed therein that are structured and arranged for connecting track supports and/or track elements to the second shell.

In embodiments, modular structure further comprises a transportation track arranged on the bottom element.

In further embodiments, the lower element further comprises at least one connection projection projecting from the lower element in a transportation direction, and at least one receiving hole configured to receive a corresponding projection from an adjacently arranged modular structure. The at least one connection projection and the at least one receiving hole permit the modular structure and the adjacently arranged modular structure to connect in an aligned manner.

In additional embodiments, the lower element further comprises at least one through hole projecting in a transportation direction through a support material formed in the lower element. The at least one through hole is structured and arranged to receive a tensioning cable so as to connect the modular structure and an adjacently arranged modular structure in an aligned manner.

In yet further embodiments, the modular structure further comprises secondary tracks arranged the second shell adjacent the upper element attachment structures.

In embodiments, the first shell, the second shell and the upper element each are formed from a planar sheet of metal.

In further embodiments, the support material comprises concrete.

Additional aspects of the present disclosure are directed to a method of forming a modular structure. The method comprises forming a bottom element structured and arranged to provide a track support surface and to provide a plurality of upper element attachment structures; and forming an upper element structured to attach to the bottom element at the plurality of upper element attachment structures, wherein the upper element is configured to sealingly engage with the lower element. Forming the bottom element comprises shaping a first shell and a second shell, arranging the first shell relative to the second shell with a gap there between, arranging at least one filler material in the gap to define at least one space for arranging at least one support material, supplying the at least one support material into the at least one space, and hardening the support material to form at least one support element in the gap that securely connects the first shell to the second shell.

In embodiments, the method further comprises removing the at least one filler material from the gap subsequent to the hardening.

In further embodiments, the method further comprises attaching track elements to the bottom element.

In additional embodiments, the first shell, the second shell and the upper element each are formed from a planar sheet of metal.

Further aspects of the present disclosure are directed to a method of forming an enclosed transportation path comprising a plurality of modular structures. The method comprises forming respective bottom elements at a first location, transporting the respective bottom elements from the first location to a job-site location, installing and connecting the respective bottom elements to form a transportation path structure, installing and/or connecting track segments of the respective bottom elements to form a transportation track, and attaching respective upper elements to respective bottom elements of the transportation path structure at the job-site location to form the enclosed transportation path.

In some embodiments, the installing the track segments of the respective bottom elements is performed prior to the transporting the respective bottom elements from the first location to the job-site location.

In additional embodiments, the transporting the respective bottom elements from the first location to a job-site location comprises transporting the respective bottom elements in a nested manner.

By implementing aspects of the disclosure, many benefits may be achieved. Benefits of the disclosure include, for example: decoupling external and internal element installation; eliminating the need for special vessels (trucks and trailers) for transportation of rolled large diameter tubes; lowering installation cost by significant margin through eliminating elevated precise track installation; removing or minimizing confined space working environments; reducing specialized installation procedures; and providing a modular fabrication and construction solution that accelerates construction of the track and transportation path and mitigates risks.

In accordance with aspects of the disclosure, by eliminating a circular tall and wide tube, it is possible to: uncouple construction phases; remove "confined space" environment; accelerate installation rate; increase ease of positioning precision; allow for modular construction; enable large scale construction; and/or impose least mass to system.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the disclosure. For a more complete understanding of the disclosure, as well as other aims and further features thereof, reference may be had to the following detailed description of the embodiments of the disclosure in conjunction with the following exemplary and non-limiting drawings wherein.

DETAILED DESCRIPTION OF THE EMBODIMENTS OF THE DISCLOSURE

Figure 1:
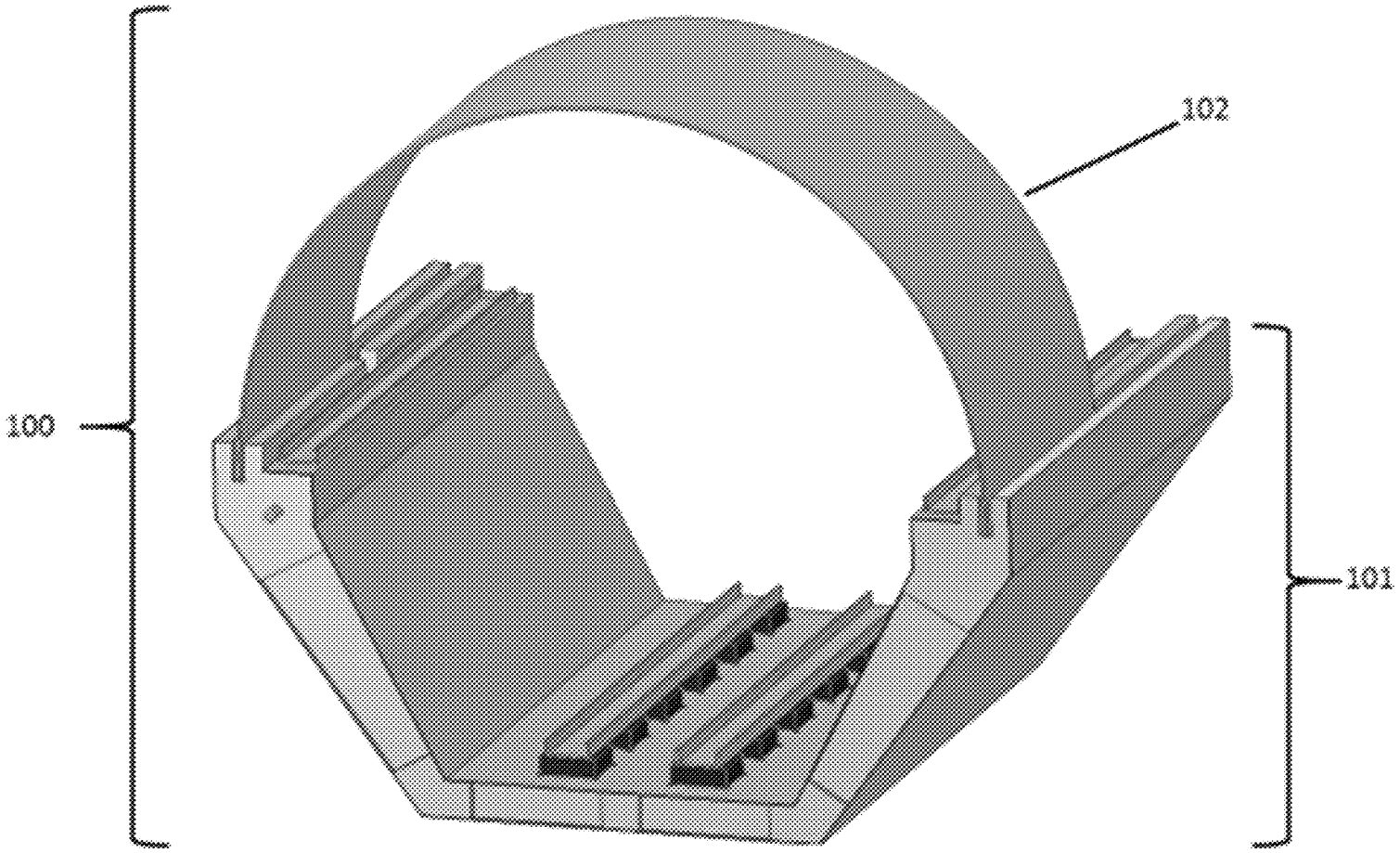
FIG. 1 shows an exemplary modular structure in accordance with aspects of the disclosure.

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also indicate that mixtures of one or more magnetic materials can be present unless specifically excluded. As used herein, the indefinite article "a" indicates one as well as more than one and does not necessarily limit its referent noun to the singular.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" indicates "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of," so that for instance "a composition comprising a compound A" may also (essentially) consist of the compound A.

The various embodiments disclosed herein can be used separately and in various combinations unless specifically stated to the contrary.

Embodiments of the present disclosure may be used in a high-speed transportation system, for example, as described in commonly-assigned application Ser. No. 15/007,783, titled "Transportation System," the contents of which are hereby expressly incorporated by reference herein in their entirety.

While the specification describes particular embodiments of the present disclosure, those of ordinary skill can devise variations of the present disclosure without departing from the inventive concept.

Exemplary embodiments described herein include components for creating an enclosed or semi-enclosed modular "tube" structure. It should be understood that the "tube" structure of the present disclosure does not connote a cylindrical tube.

The enclosed modular structure may include a bottom element and an upper element. The upper element may comprise a sheet (e.g., a flexible or deformable metal or composite sheet) with a first end portion and a second end portion. In embodiments, the sheet may be flexible such that the upper element may be roller or bent, for example. A first side end of the upper element may be mateably interact with one of the two or more grooves of the lower element and a second side end of the upper element may be mateably interact with another of the two or more grooves of the lower element.

The bottom (or lower) element may include a first shell and a second shell comprising metal sheets. In an exemplary embodiment, the lower element may include a first shell and a second shell. The second shell may be placed approximately inside the first shell. The first shell and the second shell may be separated by a gap. For example, the second shell may be arranged relative to the top of the first shell, with a gap in between the first and second shells.

The first and second shells may include a planar middle portion and one or more wing portions angled with respect to the planar middle portion. In embodiments, the wing portions may be of constant or tapered thickness.

The gap between the first and second shells (or portions thereof) may be filled by one or more filler materials and one or more support elements. In embodiments, the gap may be filled by one or more materials including: one or more support elements and one or more filler materials. The one or more support elements may be concrete. The one or more support elements may be used to maintain a static gap in between the first and second shells. The filler materials may not necessarily be structurally stiff. In accordance with aspects of the disclosure, the filler materials may be used to shape and construct the support element.

In embodiments, the filler materials and the support materials may be continuous or segmented. In an exemplary and non-limiting embodiment, the support elements may be located at or approximate the terminal ends of the wing portions and portions opposite or away from the planar middle portion.

Some of the support elements may include one or more grooves. As described above, the one or more grooves may be configured to mateably accept the first and second end portions of the upper element. In an exemplary embodiment, the lower element may include two or more grooves. The two or more grooves may be located on an upper portion of the lower element. The two or more grooves may be configured to mateably accept one or more end portions of the upper element.

In accordance with aspects of the disclosure, the modular structures are configured to be connected together to one another to form an enclosed transportation path structure for a transportation vehicle. The enclosed transportation path structure may maintain an environment different from that external to the enclosed modular structure. The enclosed modular structure, for example, may be capable of sustaining a temperature, a pressure, and/or any other condition or combination thereof, different from that of the environment external to the enclosed modular structure.

In an exemplary embodiment, the modular structure may include one or more track modules. The track modules may be affixed onto a surface of the second shell of the lower element. In accordance with aspects of the disclosure, the track modules may be affixed to the planar middle portion of the lower element.

FIG. 1 shows an exemplary partial modular structure 100 in accordance with aspects of the disclosure. As shown in FIG. 1, the modular structure 100 may include a lower element 101 and one or more upper elements 102 (only one shown). As shown in FIG. 1, ends of the upper element 102 may be inserted into grooves of the lower element 101 and secured thereto (e.g., using welding, fasteners, and/or seals) to form the modular structure 100. In an exemplary embodiment, the bottom element 101 may be formed in 5 meter sections, with other lengths contemplated by the disclosure.

In accordance with aspects of the disclosure, a plurality of modular structures 100 may be connected end-to-end to form the transportation path. As should be understood, while the modular structures 100 are not enclosed themselves (as they have openings on each side), when a plurality of modular structures 100 are connected together (and provided appropriate sealing structures on respective ends, e.g., air locks), the connected plurality of modular structures 100 are operable to provide an enclosed transportation path. In accordance with aspects of the disclosure, the enclosed transportation path is operable to provide a different environment (e.g., a low pressure environment) there within.

In accordance with aspects of the disclosure, the modular structures 100 are designed to handle a majority of expansion stresses (e.g., due to thermal expansion) within the modular structure 100 itself (e.g., between connections between the modular structures 100). It should be understood that the connections between the tube and column elements can and will dissipate thermal stressed too.

As shown in the exemplary embodiment of FIG. 1, the upper element 102 may be formed as a semi-circular (or semi-elliptical), semi-cylindrical element (e.g., from a flat metal plate). Although the upper element 102 is shown as having a semi-circular (or semi-elliptical), semi-cylindrical shape, in contemplated embodiments, the upper element may include alternative configurations such as, but not limited to, a trapezoid shape, a rectangular shape, an elliptical shape, or other geometric shapes. In further contemplated embodiments, the upper element may comprise a steel, composite material, reinforced polymer, and/or a tensioned material.

As further shown in the exemplary embodiment of FIG. 1, the upper element 102 may be sized (e.g., formed and/or shape) to be approximately one-half the length of the lower element 101 (in a longitudinal or transportation direction). Thus, as shown in the partial modular structure 100 of FIG. 1, the lower element 101 is configured to accommodate two upper elements 102, which may be connected (e.g., welded and/or fastened) to the lower element 101, and connected (e.g., welded) to each other to form a modular structure. In further contemplated embodiments, the upper elements 102 may be offset from the lower elements 101, such that a single upper element 102 spans between two adjacently arranged lower elements 101.

Figure 2:
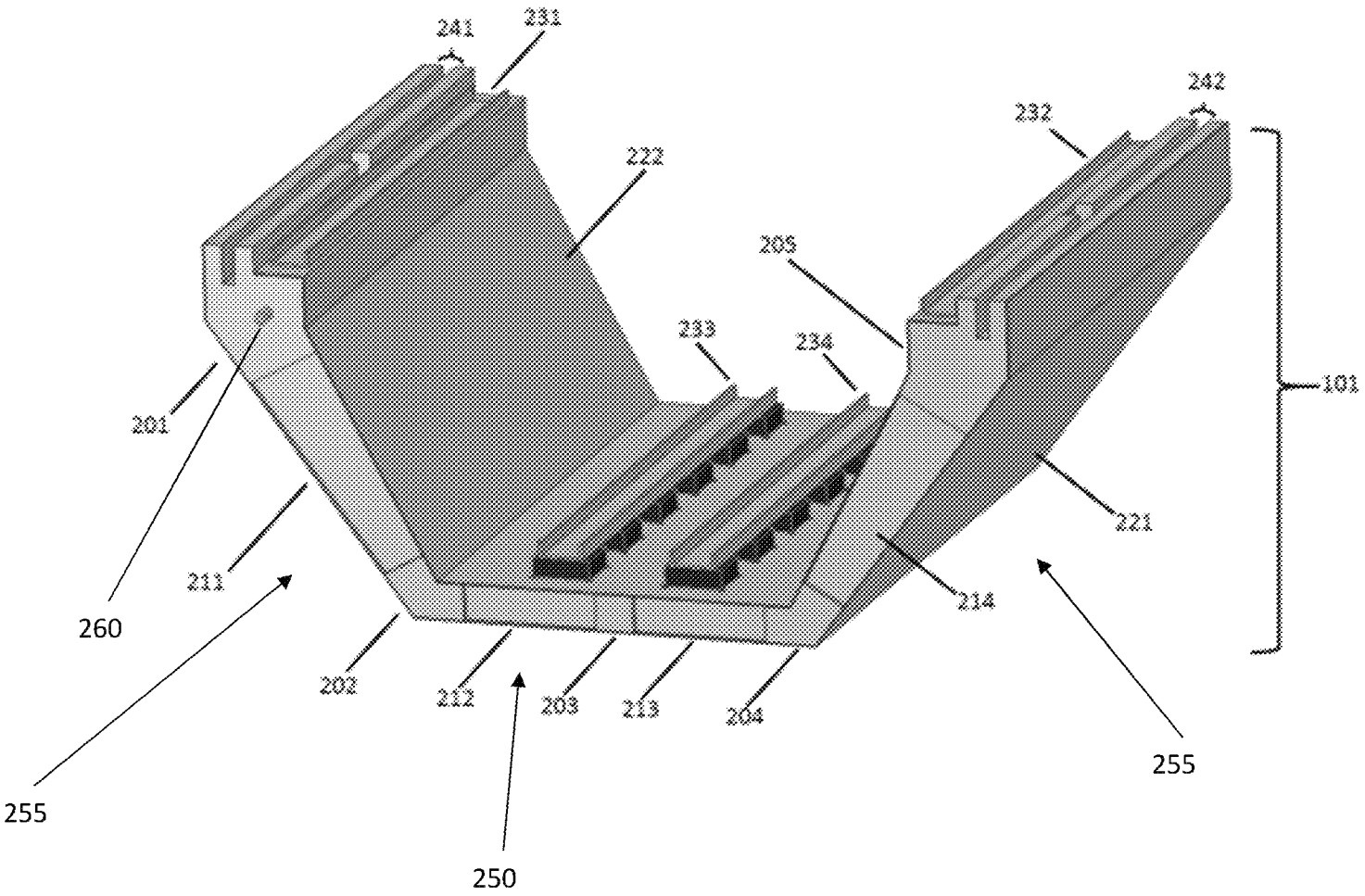
FIG. 2 shows the lower element of the modular structure in accordance with aspects of the disclosure.

FIG. 2 shows the lower element 101 of the modular structure in accordance with aspects of the disclosure. In embodiments, the bottom element 101 may include one or more shells (e.g., an outer shell 221, and an inner shell 222), one or more filler materials (e.g., filler materials 211, 212, 213, 214) arranged (e.g., temporarily) between the outer shell 221 and inner shell 222, and one or more support elements (e.g., support elements 201, 202, 203, 204, and 205) arranged between the outer shell 221 and inner shell 222. In an exemplary and non-limiting embodiment, the inner and outer shells and the upper element may each be formed from metal plates (e.g., steel plates) having a thickness of approximately ⅜", in order to minimize mass, while providing sufficient strength and stiffness.

In accordance with aspects of the disclosure, by utilizing the modular structure of the present disclosure, significant weight savings can be achieved. For example, with an exemplary embodiment of the present disclosure, the modular structure has a linear mass of approximately 3,450 kg/m. In contrast, a conventional circular diameter steel tube has a linear mass of approximately 5,700 kg/m. As such, by utilizing the modular structure of the present disclosure, significant weight savings, and thus costs, can be achieved. Additionally, in embodiments, the density of the concrete (which may be used to form the support materials or support elements) can be changed or adjusted to reduce mass of the system.

As shown in FIG. 2, in an exemplary embodiment, the outer and inner shells 221, 222 may each include a planar middle portion 250 and two wing portions 255. The wing portions 255 may be of constant or tapered thickness. For example, as shown in the exemplary embodiment of FIG. 2, the wing portions 255 have a tapered thickness. In accordance with aspects of the disclosure, the second shell 222 may be arranged relative to the first shell (e.g., placed adjacent to the first shell 221), with a gap in between the first and second shells. As shown in the exemplary and non-limiting embodiment of FIG. 2, the wing portions 255 are tapered in that the gap separation between the first shell 221 and second shell 222 is variable along a length of the wing portions 255.

As illustrated in the exemplary depiction of FIG. 2, a combination of filler materials and/or support elements may be used, such as a first filler 211, a second filler 212, a third filler 213, a fourth filler 214 and a first support element 201, a second support element 202, a third support element 203, a fourth support element 204, fifth support element 205, and any combination thereof. While the exemplary depiction of FIG. 2 utilizes four filler materials and five support elements, it should be understood that the disclosure contemplates that any combination of filler materials and support elements may be used.

In accordance with aspects of the disclosure, the filler materials and the support elements may be arranged in between the first shell 221 and second shell 222. The one or more support elements 201, 202, 203, 204, and 205 may maintain (or aid in maintaining) the second shell 222 at a fixed distance relative to the first shell 221 and provide support to the lower element of the modular structure 100. The one or more support elements 201, 202, 203, 204, and 205 may include concrete or any other suitable material.

In embodiments, the support material may be concrete, reinforced concrete (e.g., with rebars), epoxy, a composite material of concrete and a fiber-reinforced polymer. In embodiments, the concrete may be pre-stressed. In some embodiments, rebars may be utilized in each section (e.g., each modular lower element 101).

In embodiments, the one or more filler materials 211, 212, 213, 214 may comprise a plastic or foam and may be very light and/or may lack structural stiffness. In accordance with aspects of the disclosure, the one or more filler materials 211, 212, 213, 214 may confine the one or more support elements 201, 202, 203, 204, and 205 during formation to predetermined locations between the first and second shells 221, 222. For example, in some contemplated embodiments, the sole function of the filler materials is to confine, e.g., cementitious volume materials during solidification thereof.

In accordance with aspects of the disclosure, the filler materials 211, 212, 213, 214 may be arranged between the first shell 221 and second shell 222, such that the filler materials 211, 212, 213, 214, the first shell 221, and second shell 222 define spaces for forming therein the one or more support elements 201, 202, 203, 204, and 205. Thus, once the filler materials 211, 212, 213, 214 are arranged between the first shell 221 and second shell 222, such that the filler materials 211, 212, 213, 214, the first shell 221, and second shell 222 define spaces, support element material (e.g., concrete, epoxy) may be arranged (e.g., poured) into the defined spaces so as to form the one or more support elements 201, 202, 203, 204, and 205. In embodiments, once the support elements 201, 202, 203, 204, and 205 solidify (e.g., harden, set, and/or cure), the filler materials 211, 212, 213, 214 may be removed from the structure. In other contemplated embodiments, the filler materials 211, 212, 213, 214 may remain after the support elements 201, 202, 203, 204, and 205 solidify (e.g., harden, set, and/or cure). For example, in embodiments where the filler materials 211, 212, 213, 214 remain, the filler materials 211, 212, 213, 214 may also be utilized to provide insulation and/or vibration noise reduction.

As shown with the exemplary depiction of FIG. 2, the first filler 211 material may be may be located substantially in the gap in between one of the wing portion 255 of the first and second shells 221, 222 and the fourth filler 214 material may be located substantially in the gap in between the other wing portion 255 of the first and second shells 221, 222. The second support element 202 may be placed (e.g., poured or arranged) in between the first filler 211 and second filler 212 materials arranged at the intersection of the wing portion 255 and the planar portion 250. The third support element 203 may be placed in between the second 212 and the third 213 filler materials, e.g., approximately at the center between tracks 233, 234. The fourth support element 204 may be formed (or placed) in between the third 213 and fourth 214 filler materials arranged at the intersection of the other wing portion 255 and the planar portion 250. The support elements 201, 202, 203, 204, and 205 and the filler materials may be longitudinally placed within the gap in between the first and second shells 221, 222. In embodiments, the support elements 201, 202, 203, 204, and 205 may be continuous or segmented, or any combination thereof.

As shown in FIG. 2, the first support element 201 may include a first groove 241 and the fifth support element 205 may include a second groove 242. The first groove 241 and second groove 242 are provided to accommodate the respective ends of the upper elements 102 (e.g., see FIG. 1).

As further shown in FIG. 2, in some embodiments, the support element 201 may be formed to include one or more connection posts 260 structured and arranged for facilitating an aligned connection between adjacent modular sections 100. While not shown in FIG. 2, the other end of the first support element 201 may include a corresponding insertion hole structured and arranged for receiving a connection post 260 from an adjacent modular section 100 therein. In embodiments, a connection post 260 (and corresponding receiving hole, which is not shown) may be formed when forming the support element 201. While the exemplary embodiment of FIG. 2 only depicts one connection post 260, the disclosure contemplates that other support elements (e.g., support elements 202, 203, 204, and/or 205) may also include a connection post 260 (and corresponding receiving holes on opposite ends thereof).

Additionally, in other contemplated embodiments, one or more through holes may additionally be formed (e.g., at the approximate location of the connection post 260, or adjacent thereto) that traverses the support element 201 from one side to the other. In embodiments, the hole may be formed by arranging a pipe or conduit structure relative to the first and second shells 221, 222 prior to forming the support element 201, and optionally removing the pipe or conduit structure prior to concrete hardening, so as to form the through hole. Once a plurality of modular structures are aligned relative to one another, one or more wires or cables (e.g., steel cable), for example, may be passed though the respective through holes and tensioned so as to secure the adjacent modular structures to one another. In further contemplated embodiments, the one or more through hoes may be used for accommodating communication cables, power cables, etc. While the exemplary discussed embodiment only describes one through hole, the disclosure contemplates that other support elements (e.g., support elements 202, 203, 204, and/or 205) may also include through holes.

Figure 3:
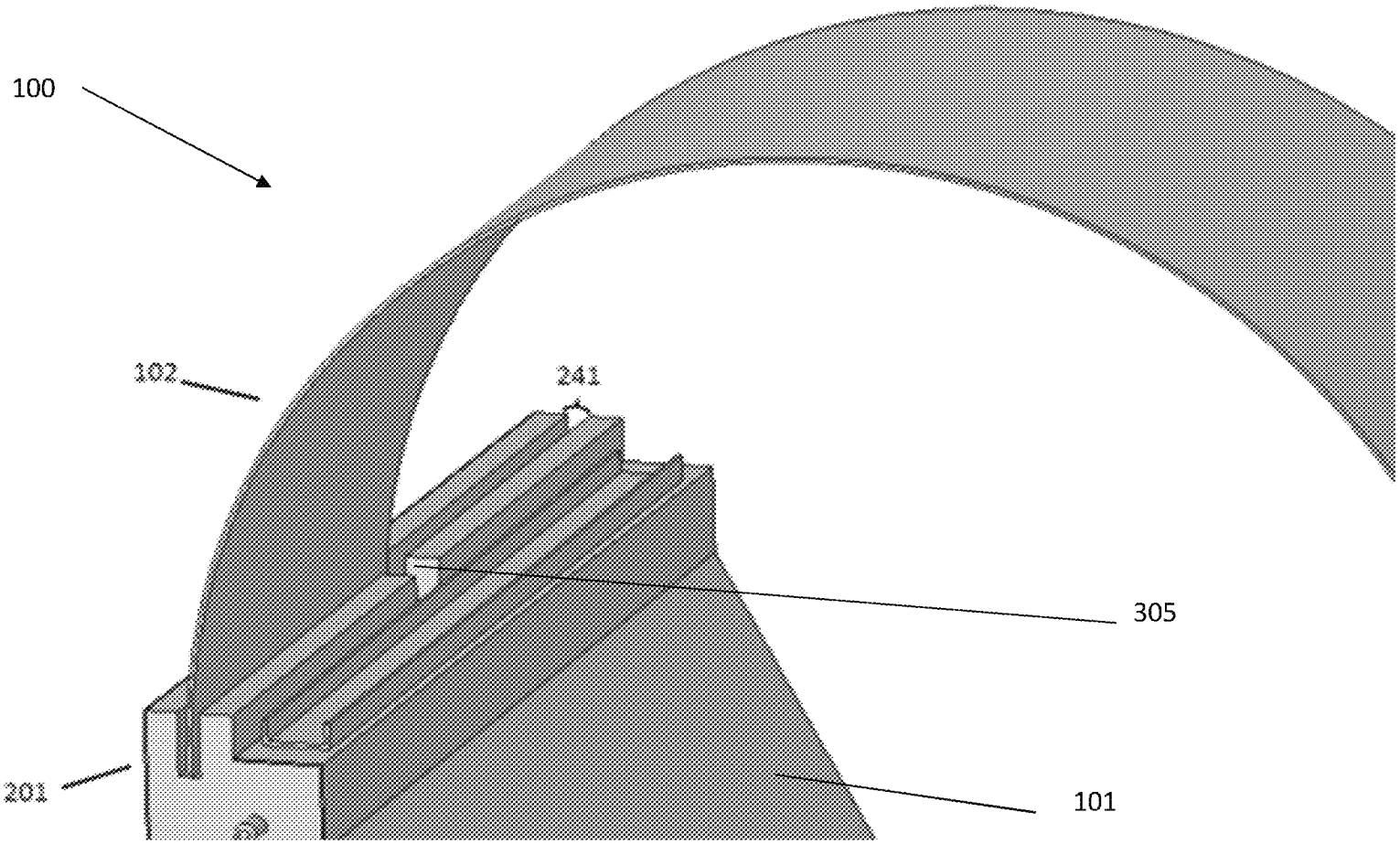
FIG. 3 shows a close-up view of the connection between the lower element and the upper element of the modular structure including a first groove of the bottom element in accordance with aspects of the disclosure.

FIG. 3 shows a close-up view of the connection between the bottom element 101 and the upper (or top) element 102 of the modular structure 100 including a first groove 241 of the first support element 201 of the bottom element 101 in accordance with aspects of the disclosure. As shown in FIG. 3, a first side (or end) of the upper element 102 is configured to mateably fit into the first groove 241. A second side of the upper element 102 is configured to mateably fit into the second groove 242 (as shown in FIG. 1). Once arranged in the respective grooves 241, 242 of the lower element 101, the upper element 102 may be secured thereto via, e.g., welding, fasteners, and/or adhesive. Additionally, in embodiments, a sealing material (e.g., elastomeric sealing material) may be arranged in the first groove 241 and the second groove 242 to assist in providing a sealed connection between the lower element 101 and the upper element 102. As shown in FIG. 3, in embodiments, the first groove 241 (and the second groove 242) may each include one or more welding start spots 305, which are provided to allow access (e.g., for a robot welder) for welding the seam between two adjacently arranged upper elements 102. As should be understood, depending on how the upper elements 102 are arranged on the lower elements 101 (e.g., aligned as depicted in FIG. 1 or offset, as discussed above), the one or more welding start spots 305 may be arranged (or formed) in different positions (e.g., where a seam between two upper elements 102 is arranged).

Figure 4:
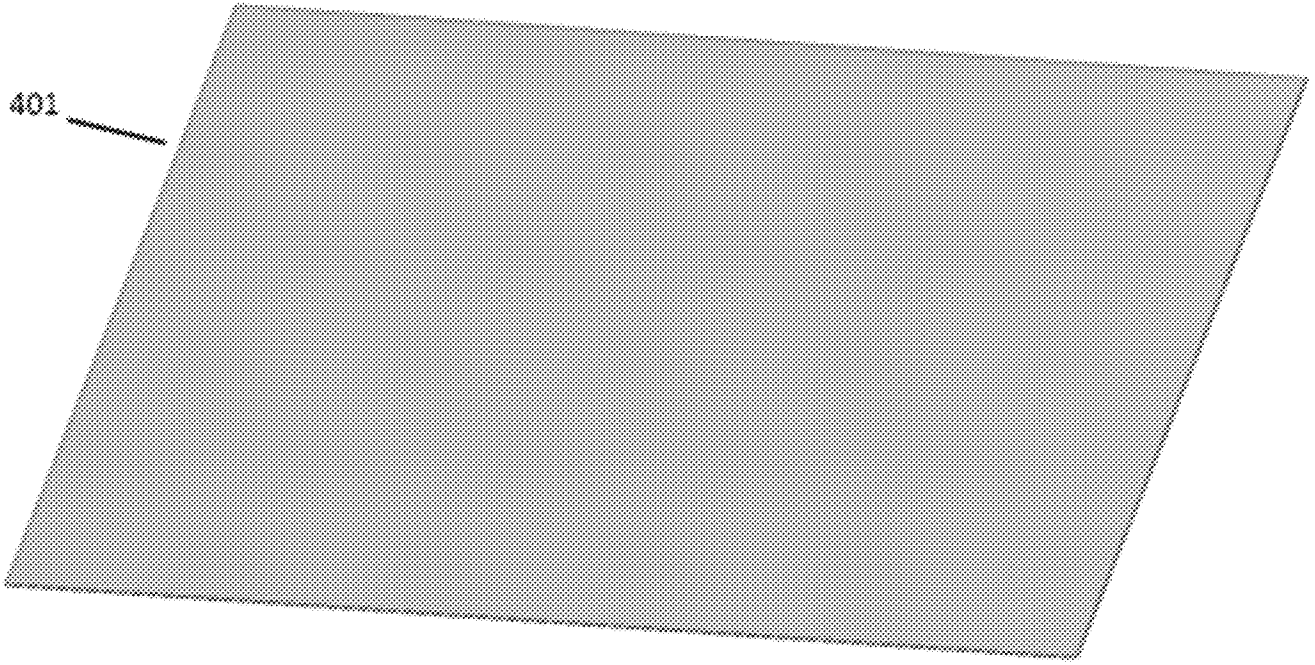
FIG. 4 shows a substantially flat plate, which may be shaped into either the first shell or the second shell of the bottom element in accordance with aspects of the disclosure.

FIG. 4 shows a substantially flat plate 401, which may be shaped into either the first shell 221 or the second shell 222 of the bottom element 101 (as shown in FIG. 2) in accordance with aspects of the disclosure.

Figure 5:
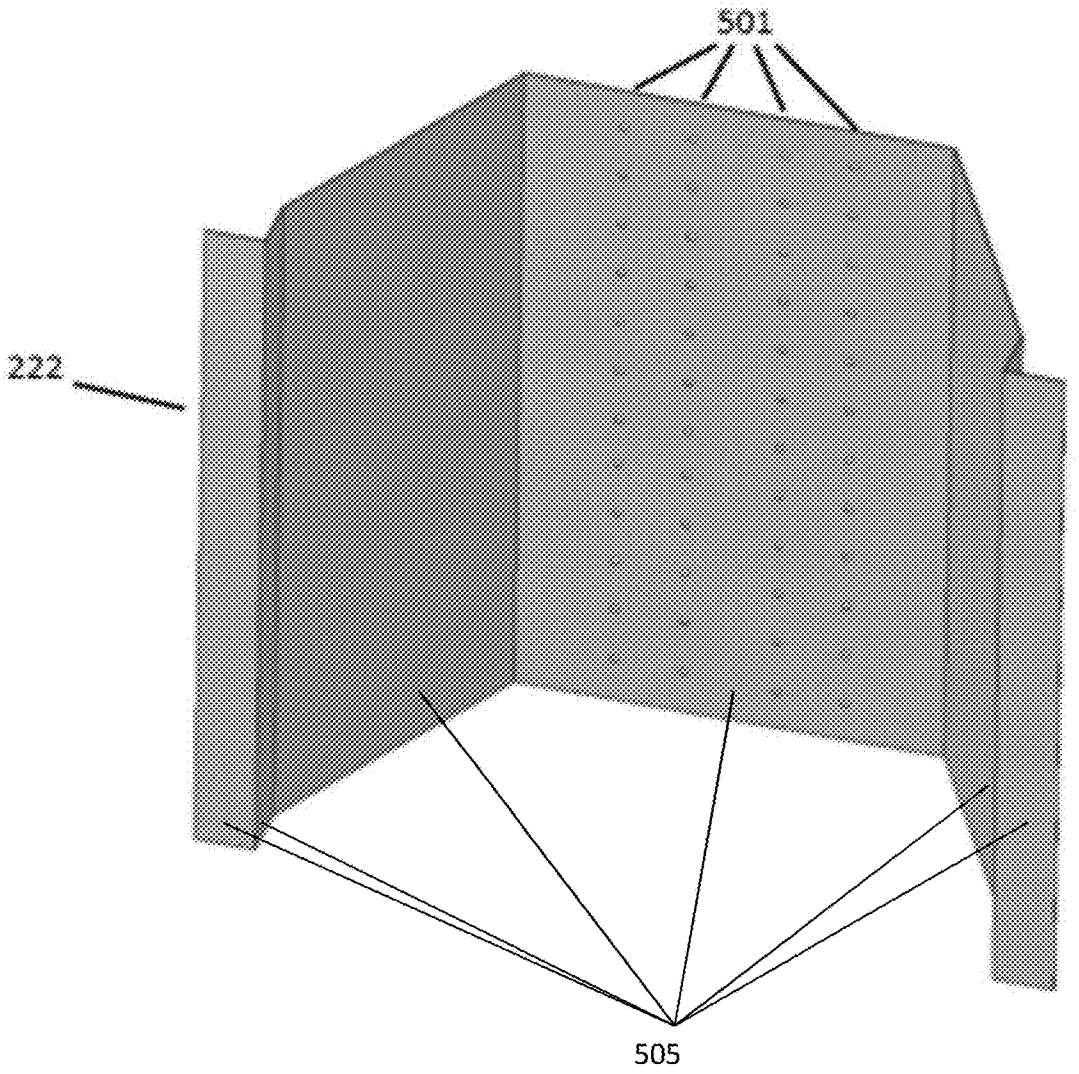
FIG. 5 shows a first surface of the second shell after the second shell has been shaped, in accordance with aspects of the disclosure.

FIG. 5 shows a first side surface 505 of the second shell 222 after the second shell 222 has been shaped from the substantially flat plate 401 (see FIG. 4) in accordance with aspects of the disclosure. As shown in FIG. 5, the second shell 222 may include a plurality of holes 501. In accordance with aspects of the disclosure, the plurality of holes 501 may be used to attach objects to the second shell 222.

Figure 6:
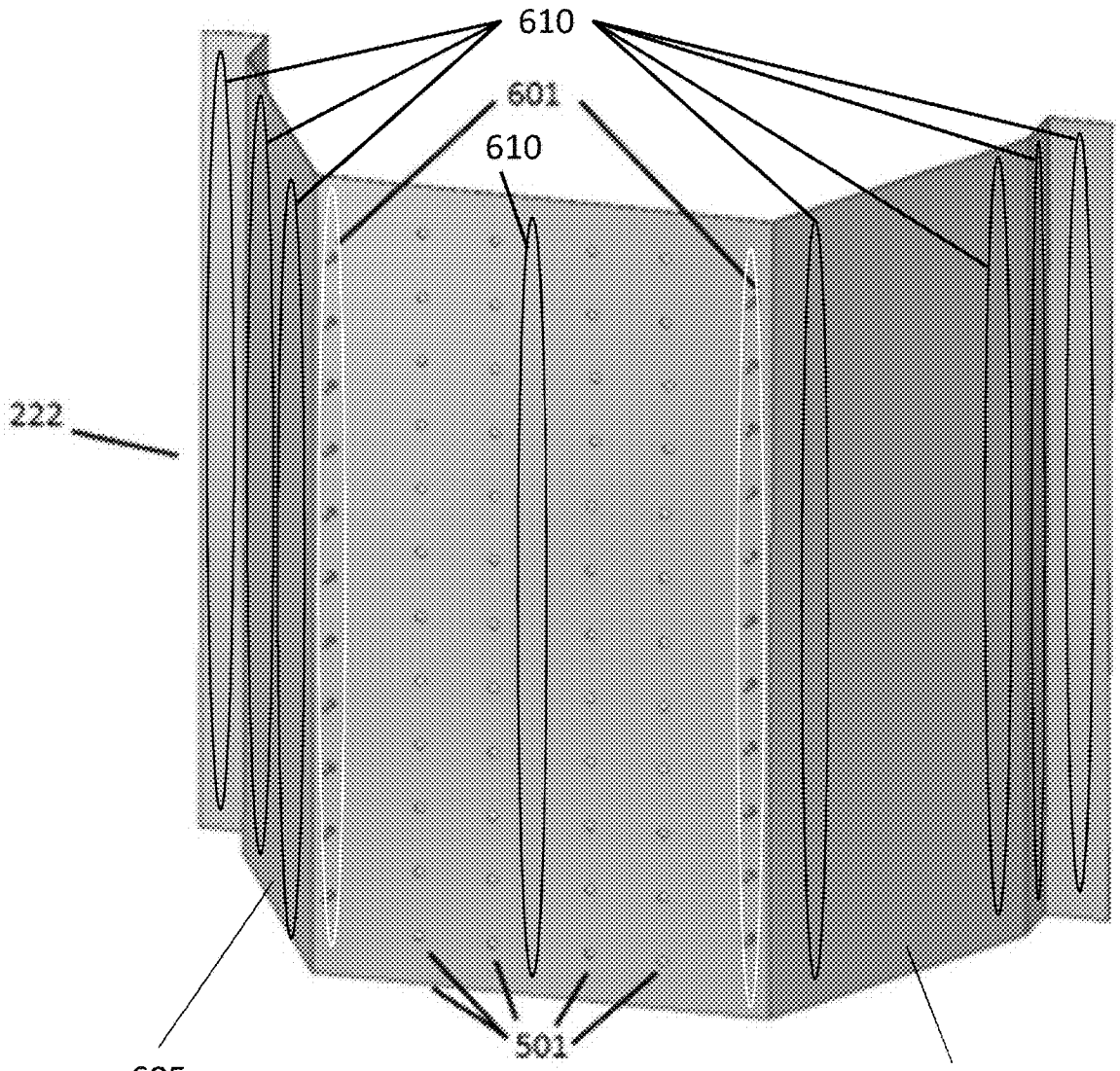
FIG. 6 shows a second surface of the second shell in accordance with aspects of the disclosure.

FIG. 6 shows a second side surface 605 of the second shell 222 in accordance with aspects of the disclosure. As shown in FIG. 6, the second shell 222 may include, along with the plurality of holes 501, a plurality of shear stud arrangements 601, which may be attached via welding, for example. In accordance with aspects of the disclosure, the shear studs of the shear stud arrangements 601 may be utilized to provide a more secure connection to the concrete of the support elements (e.g., by increasing a surface area of contact to the concrete). While FIG. 6 illustrates the plurality of shear stud arrangements 601 along the edges of the planar middle portion, it should be understood that shear studs may be arranged adjacent wherever the support elements will be located (e.g., in other shear stud arrangement areas 610). Additionally, while the exemplary embodiment depicts the shear stud arrangements 601 arranged on the second shell 222, it should be understood that the disclosure contemplates shear stud arranged (e.g., alternatively or additionally) on the first shell 221.

Figure 7:
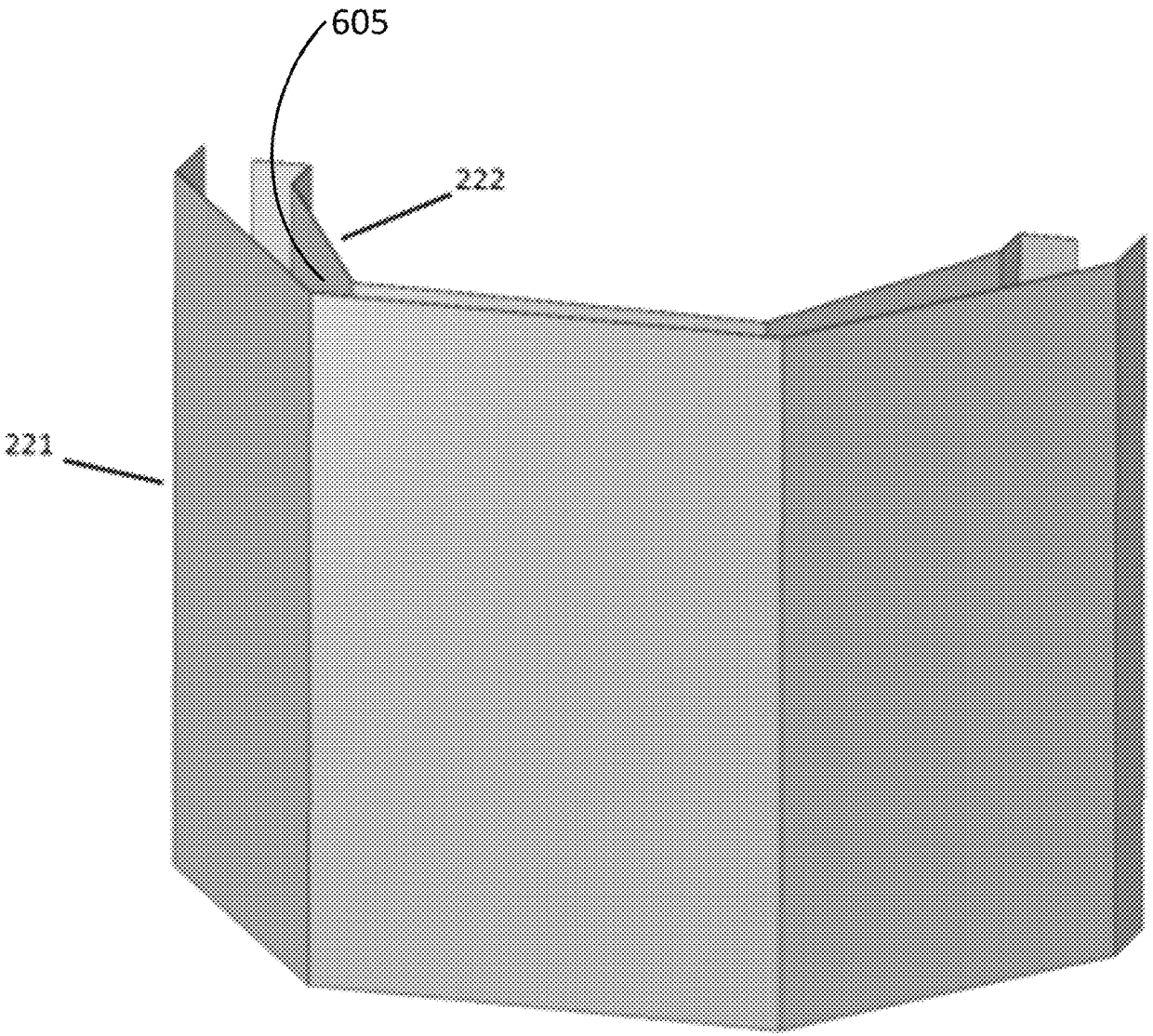
FIG. 7 shows the first shell arranged relative to (e.g., surrounding) the second shell in accordance with aspects of the disclosure.

FIG. 7 shows the first shell 221 arranged relative to (e.g., surrounding) the second shell 222 in accordance with aspects of the disclosure. The second surface 605 of the second shell 222 is arranged to face the first shell 221. When constructing the modular structure 100, the first and second shells 221, 222, for example, may be placed vertically in a pre-casting facility. The pre-casting facility may be configured to arrange the first and second shells 221, 222 with the proper spacing there between for forming the filler materials and support materials there between.

Figure 8:
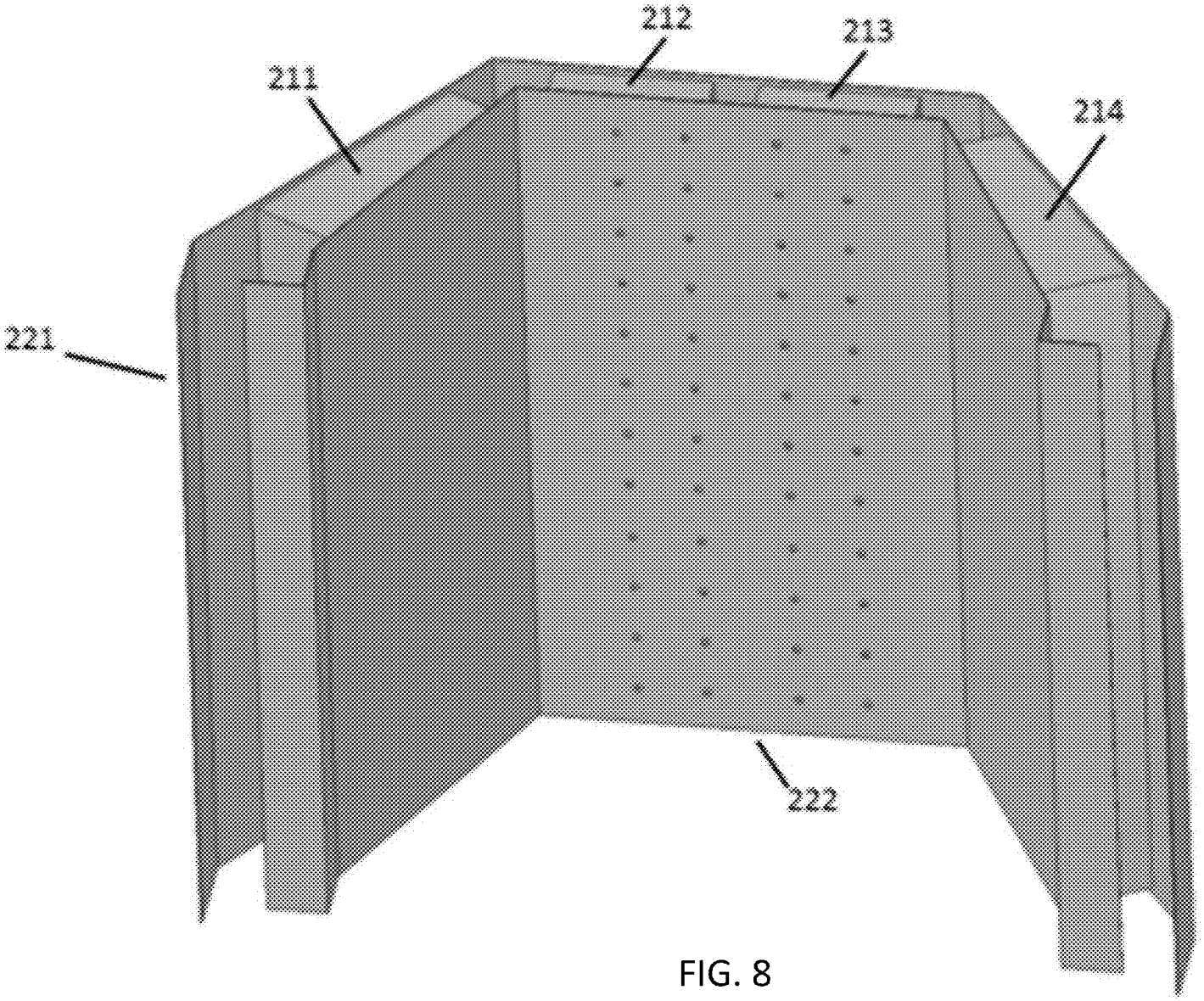
FIG. 8 shows the placement of the one or more filler materials in between the first and second shells in accordance with aspects of the disclosure.

FIG. 8 shows the placement (or arrangement) of the one or more filler materials 211, 212, 213, 214 in between the first and second shells 221, 222 in accordance with aspects of the disclosure. As should be understood, the placement of the filler materials 211, 212, 213, 214 may be performed manually and/or in an automated fashion using appropriate material handlers (e.g., robots).

Figure 9:
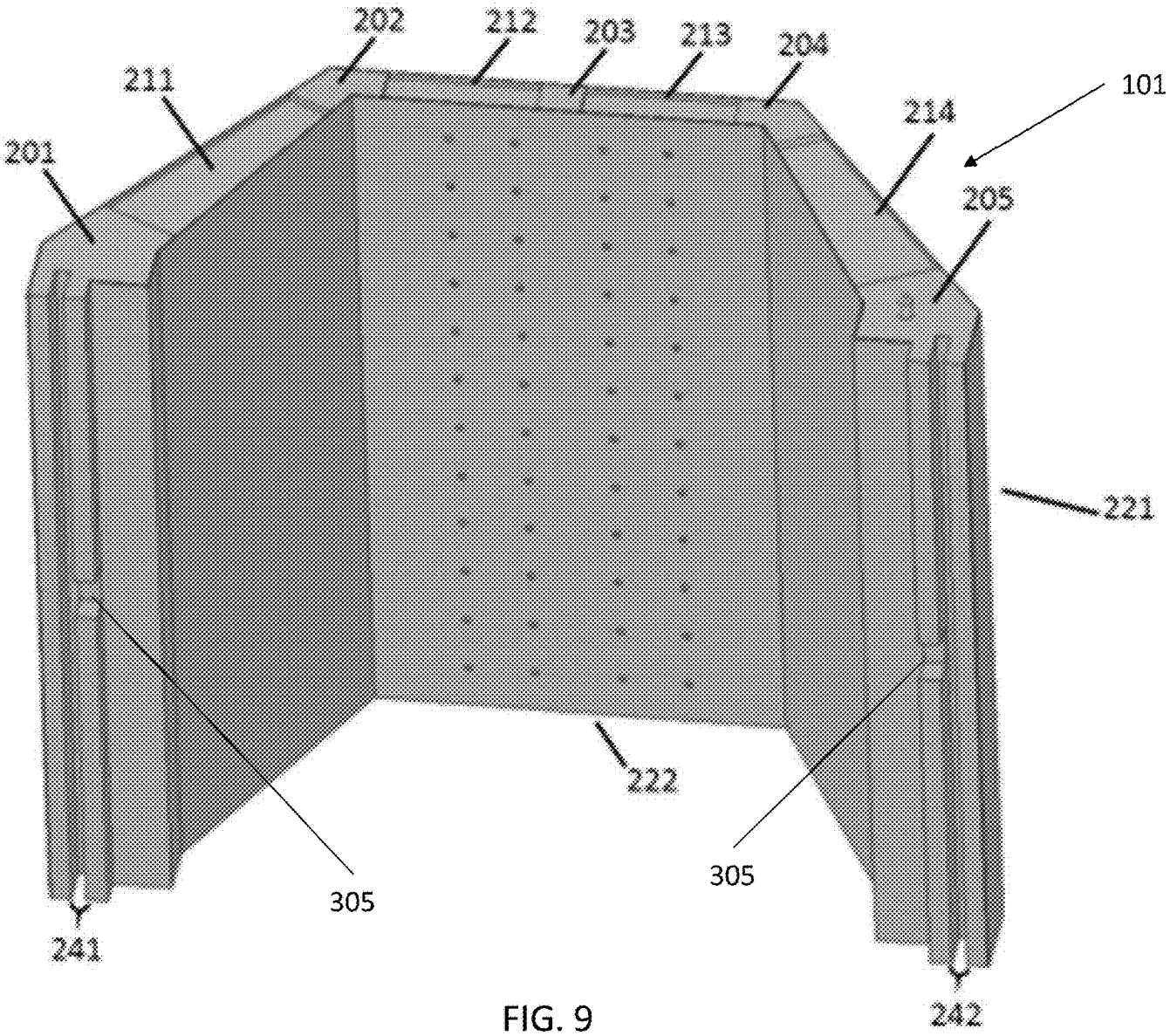
FIG. 9 shows the placement of the one or more support materials in between the first and second shells in accordance with aspects of the disclosure.

FIG. 9 shows the placement of the one or more support materials 201, 202, 203, 204, and 205 in between the first and second shells 221, 222 in accordance with aspects of the disclosure. For example, after the one or more filler materials 211, 212, 213, 214 are placed, one or more support materials 201, 202, 203, 204, and 205 may be poured into the spaces defined between the second shell 222, the first shell 221, and the one or more filler materials 211, 212, 213, 214, as shown in FIG. 9. The support material may then harden and/or solidify, which may form one or more support elements 201, 202, 203, 204, 205. The one or more support elements may include a first support element 201 and a fifth support element 205, or any number of support elements. The support elements may be separate, continuous, integrated, coupled, or otherwise arranged with one or more other support elements. The first support element 201 may be shaped (e.g., using an appropriately formed mold and/or post concrete-forming subtractive manufacturing) to include the first groove 241, and the fifth support element 205 may be shaped to include the second groove 242. In accordance with aspects of the manufacturing process of the present disclosure, in embodiments, external forming and molding is limited to grouting grooves 241, 242 and welding pockets 305.

Figure 10:
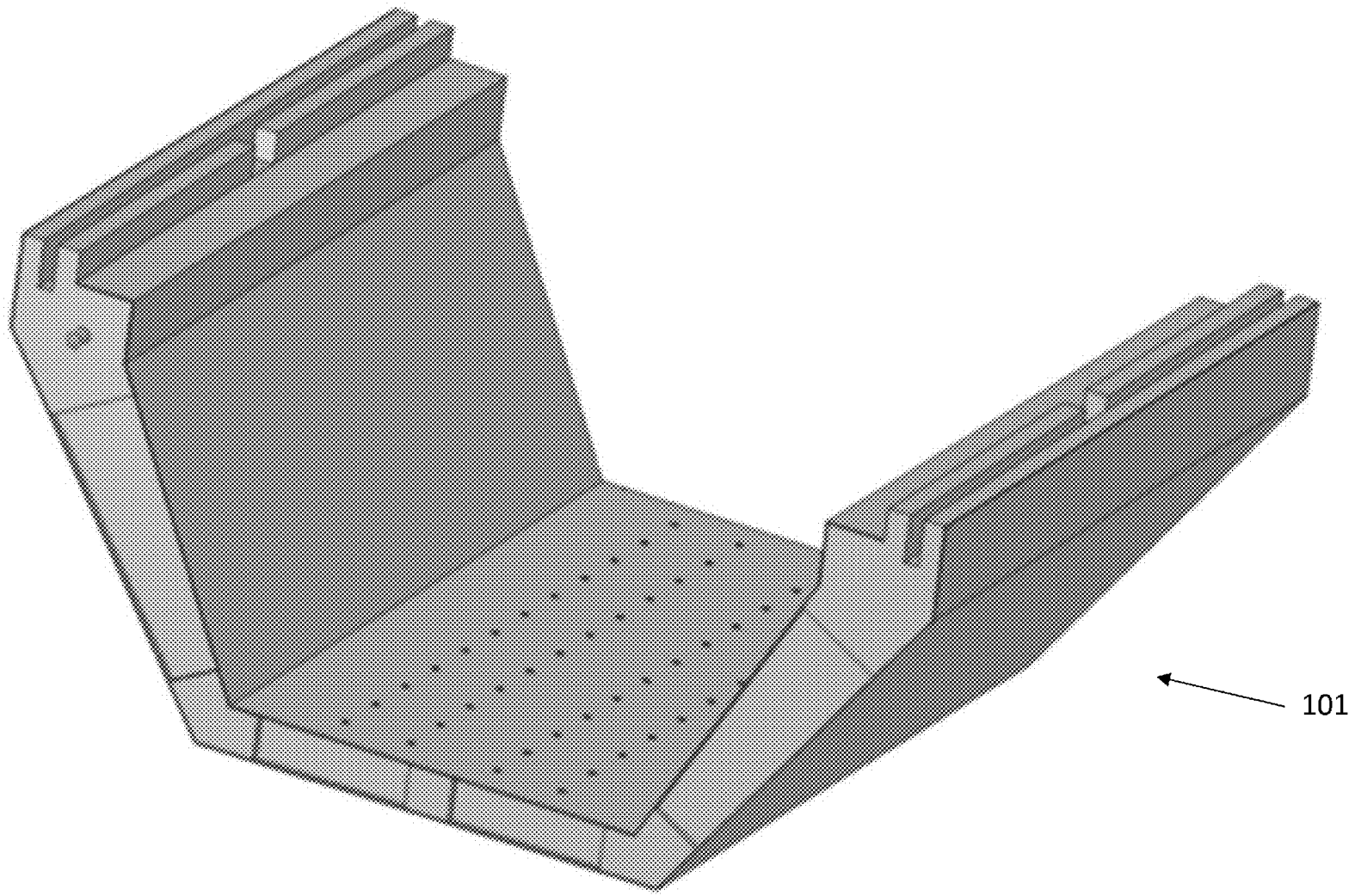
FIG. 10 shows a view of the bottom element of the modular structure after the support material is in place and connection joints are set in accordance with aspects of the disclosure.

FIG. 10 shows a view of the bottom element 101 of the modular structure after the support material is solidified in place to form the support elements 201, 202, 203, 204, 205 in accordance with aspects of the disclosure.

Figure 11:
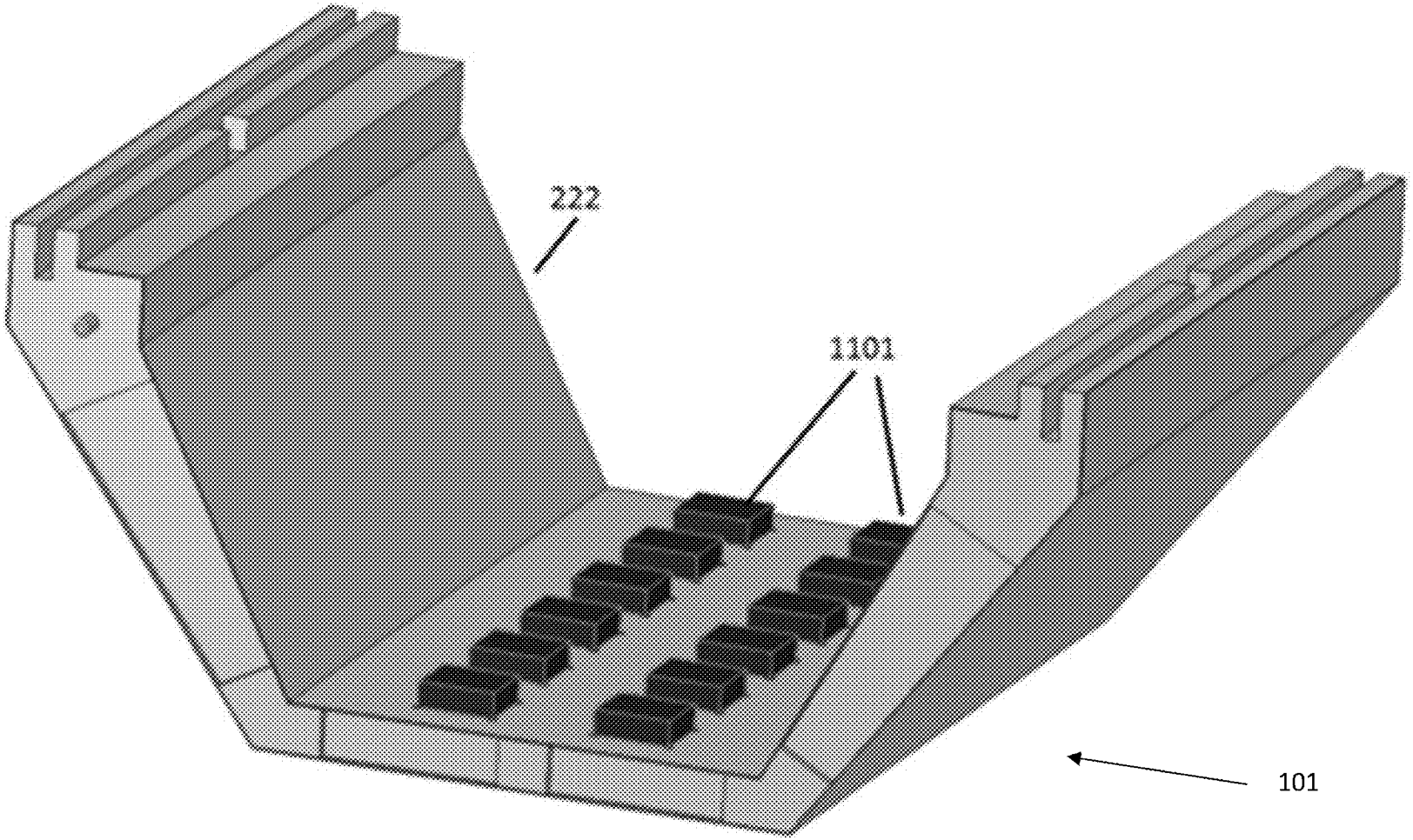
FIG. 11 shows the attachment of a plurality of pads to the plurality of holes of the bottom element in accordance with aspects of the disclosure.
Figure 12:
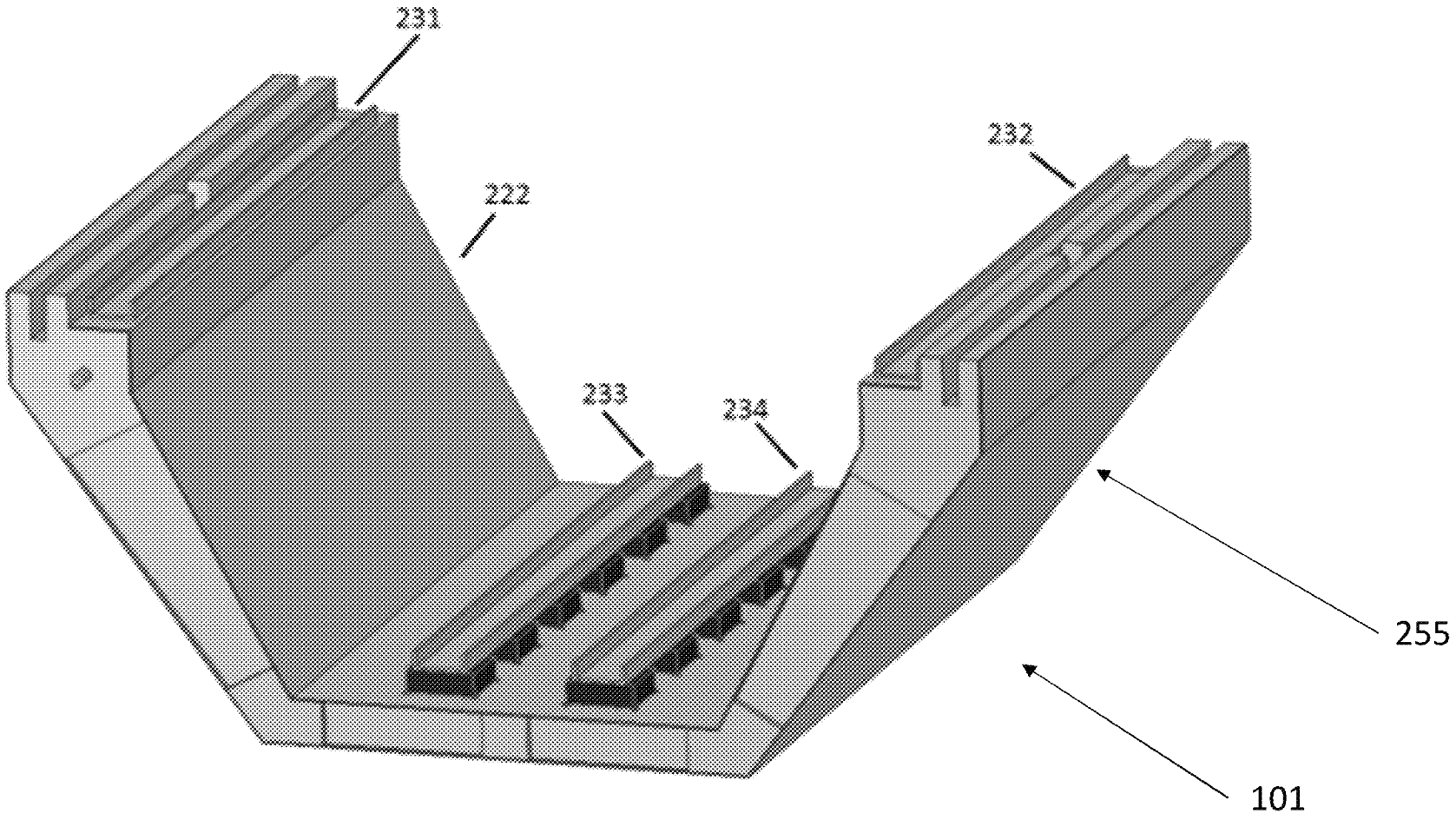
FIG. 12 schematically depicts tracks that may be attached to the plurality of pads of the bottom element in accordance with aspects of the disclosure.

FIG. 11 depicts the attachment of a plurality of pads 1101 to the plurality of holes (not shown) of second shell 222 of the bottom element 101 in accordance with aspects of the disclosure. In accordance with aspects of the disclosure, the plurality of pads 1101 may provide clearance between the second shell 222 and one or more track modules (e.g., magnetic track modules) (as shown in FIG. 12). In embodiments, the plurality of pads 1101 may be magnetically neutral. In embodiments, the pads 1101 may comprise an elastomeric material. While the exemplary and non-limiting embodiment of FIG. 11 shows a plurality of pads (e.g., five pads 1101) aligned in two rows, it should be understood that the plurality of pads 1101 may be configured in any suitable configuration.

FIG. 12 schematically depicts tracks that may be attached to the plurality of pads 1101 of the bottom element 101 in accordance with aspects of the disclosure. As shown in FIG. 12, a first track module may include a first set of tracks 233, 234 that may be attached to the plurality of pads. In embodiments, the first set of tracks 233, 234 may be magnetic (or include magnetic elements) for propulsion and/or levitation of a vehicle in the transportation system. As shown in FIG. 12, a second track module may include a second set of tracks 231, 232 that may be attached to the first surface of the second shell 222, on top of the wing portions 255 of the second shell 222. In accordance with aspects of the disclosure, the second set of tracks 231, 232 may provide a dedicated track system for guiding the vehicle (wherein the first set of tracks 233, 234 may be configured for propulsion and/or levitation). Providing a dedicated track system (e.g., in a separate special or dedicated plane) for guiding the vehicle may provide for improved operational banking and/or junction design (e.g., at a "Y" junction of transportation paths).

In accordance with aspects of the disclosure, at this point in the construction process, the lower element 101 of the modular structure 100 may be transported to a work site where multiple lower elements 101 may be combined to form an integrated structure. In accordance with aspects of the disclosure, at this stage of construction, the integrated structure of the multiple lower elements 101 is an open structure that does not present confined spaces. Thus, in this stage, pre-installed tracks may be connected to tracks of adjacent lower elements while not presenting a confined space environment. In other contemplated embodiments (e.g., without fully installed tracks in the lower elements), at this stage tracks may be installed (or installation may be completed) and the tracks may be connected to tracks of adjacent lower elements while not presenting a confined space environment. The upper element 102 (or a plurality of upper elements 102) of the modular structure 100 may then be formed and placed on the lower element 101 and fixed to the first and second grooves 241, 242, as shown in FIGS. 1 and 3.

In other contemplated embodiments, upper element 102 (or a plurality of upper elements 102) of the modular structure 100 may be installed on the lower element 101 prior to track installation completion. In accordance with aspects of the disclosure, in embodiments, the upper element 102 may be formed by bending a sheet of metal (and not by cutting a tubular segment from a formed cylindrical tube). As such, with the modular tube structure of the present disclosure, preformed cylindrical tubular structures are not necessary, and in accordance with aspects of the disclosure, the numerous drawbacks of using preformed cylindrical tubular structures in an enclosed environment transportation system can be avoided.

Although the upper element 102 is shown as having a semi-circular (or semi-elliptical), semi-cylindrical shape, in contemplated embodiments, the upper element may include alternative configurations such as, but not limited to, a trapezoid shape, a rectangular shape, an elliptical shape, or other geometric shapes. In further contemplated embodiments, the upper element may comprise a steel, composite material, reinforced polymer, and/or a tensioned material.

In accordance with aspects of the disclosure, by constructing an exemplary embodiment of the lower element at a facility off-site, higher-tolerances may be achieved. Constructing with higher tolerances is important for long-distance tracks where a small error can get multiplied over long distances.

By implementing aspects of the disclosure, the circular tube constraint is eliminated, the construction phases can be uncoupled, the confined spaces can be eliminated, installation times can be accelerated, positioning precision can be increased, large scale construction is enabled, a least-mass-to-system is imposed on the system, and modular construction is achieved.

Figure 13:
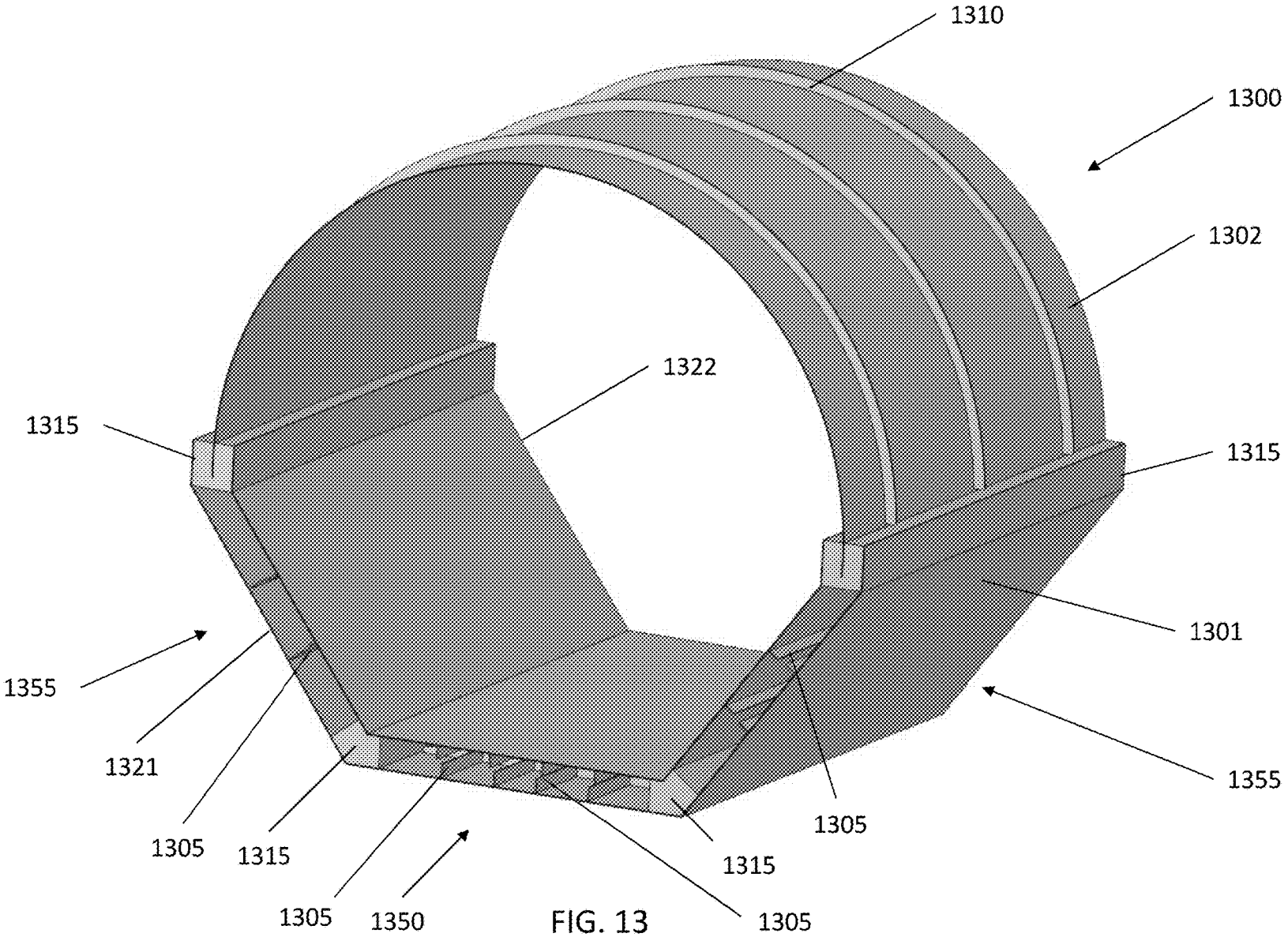
FIG. 13 shows an exemplary modular structure in accordance with aspects of the disclosure.

FIG. 13 shows an exemplary modular structure 1300 in accordance with aspects of the disclosure. As shown in FIG. 13, the modular structure 1300 may include a lower element 1301 and one an upper element 1302. As shown in FIG. 13, ends of the upper element 1302 may be inserted into grooves of the support elements 1320 of the lower element 1301 and secured thereto (e.g., using welding, fasteners, and/or seals) to form the modular structure 1300. In an exemplary embodiment, the bottom element 1301 may be formed in 5 meter sections, with other lengths contemplated by the disclosure. In accordance with aspects of the disclosure, a plurality of modular structures 1300 may be connected end-to-end to form the transportation path.

As further shown in the exemplary embodiment of FIG. 13, the upper element 1302 may be sized (e.g., formed and/or shape) to be approximately the same length of the lower element 1301 (in a longitudinal or transportation direction). Thus, as shown in the modular structure 1300 of FIG. 13, the lower element 1301 is configured to accommodate one upper element 1302, which may be connected (e.g., welded and/or fastened) to the lower element 1301. As shown in FIG. 13, the upper element 1302 may include one or more circumferential ribs 1310 (e.g., three ribs 1310) to provide increased structural integrity to the upper element 1302. In embodiments, the ribs 1310 may be welded to the upper element after the upper element 1302 is formed and attached to the lower element 1301. Additionally, in embodiments, the ribs 1310 may also be attached to the lower element 1301 (e.g., fastened and/or welded to the lower element 1301).

As shown in FIG. 13, the lower element 1301 includes a planar middle portion 1350 and two wing portions 1355. With this exemplary and non-limiting embodiment, the wing portions 1355 have a constant thickness. As shown in FIG. 13, the wing portions 1355 are not tapered such that the gap separation between the first shell 1321 and second shell 1322 is approximately constant along a length of the wing portions 1355. In accordance with aspects of the disclosure, with such a construction and structure, (e.g., the first shell 1321 and second shell 1322 having the same approximate shape) the lower elements 1301 may be more efficiently nested during transportation and/or storage. As shown in FIG. 13, with embodiments including the wing portions 1355 having a constant thickness, no region may be provided on the support elements 1320 on top of the wing portions 1355 of the second shell for a second set of tracks (e.g., guidance tracks).

As further shown in FIG. 13, with this exemplary embodiment, the lower element 1301 includes framing members 1305 (or stiffeners) between the first shell 1321 and second shell 1322 in both the planar middle portion 1350 and two wing portions 1355. In an exemplary and non-limiting embodiment, the framing members 1305 (or stiffeners) may have a thickness of approximately 0.5". In embodiments, the framing members 1305 may be attached to (e.g., welded to) the first shell 1321 and/or the second shell 1322. In embodiments, the framing members 1305 may be structured and arranged to provide structural strength, support and/or redundancy to the lower element 1301. Additionally, in embodiments, the framing members 1305 may be used to properly space the first shell 1321 and the second shell 1322 during formation of the lower element 1302. In some contemplated embodiments, the framing members 1305 may be utilized in lieu of (or in addition to) the above-described filler materials to form the support elements 1315, 1320.

Figure 14:
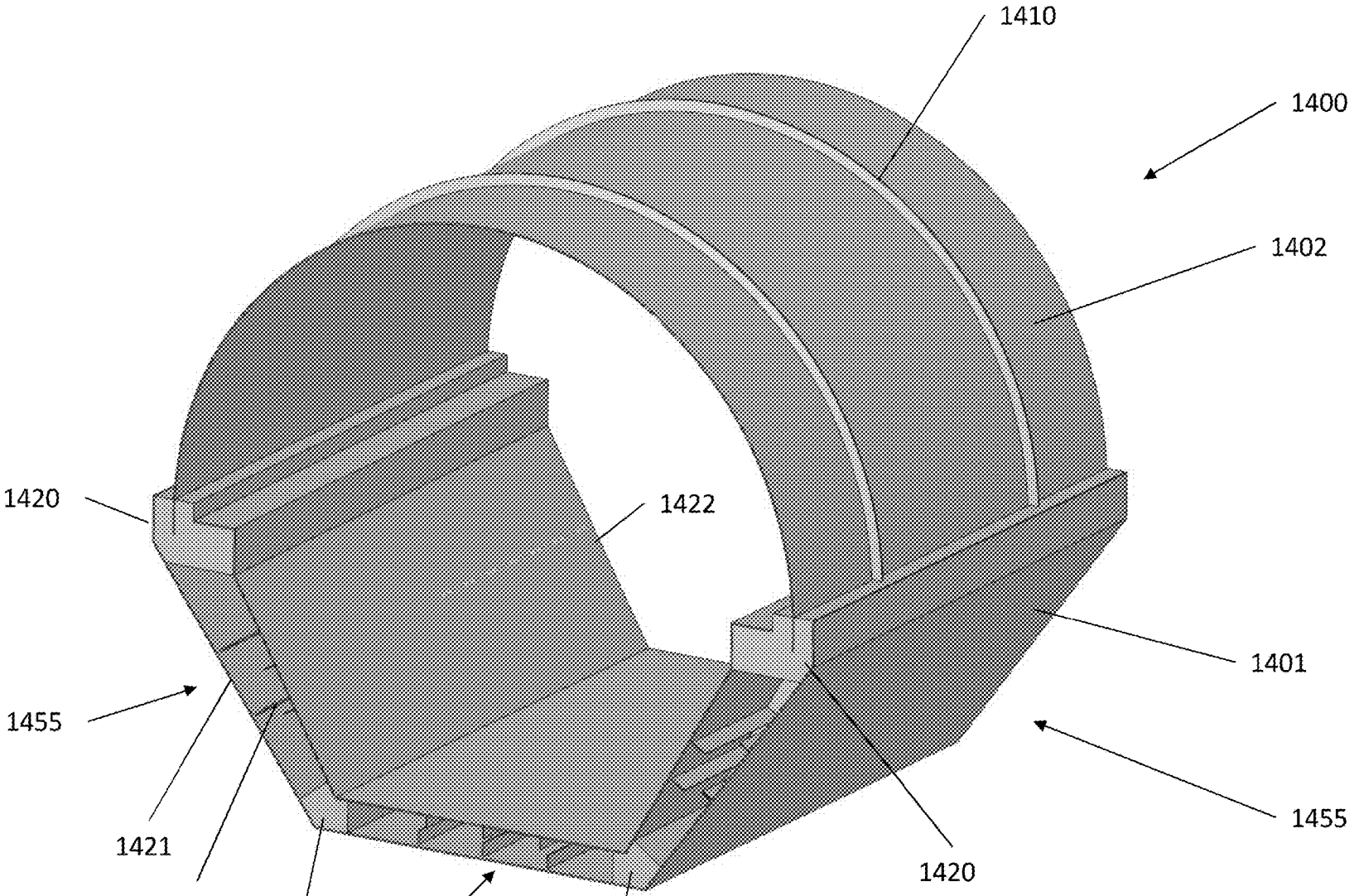
FIG. 14 shows an exemplary modular structure in accordance with aspects of the disclosure.

FIG. 14 shows an exemplary modular structure 1400 in accordance with aspects of the disclosure. As shown in FIG. 14, the modular structure 1500 includes a lower element 1401 and one an upper element 1402. As shown in FIG. 14, ends of the upper element 1302 may be inserted into grooves of the support elements 1420 of the lower element 1401 and secured thereto (e.g., using welding, fasteners, and/or seals) to form the modular structure 1400. In an exemplary embodiment, the bottom element 1401 may be formed in 5 meter sections, with other lengths contemplated by the disclosure. In accordance with aspects of the disclosure, a plurality of modular structures 1400 may be connected end-to-end to form the transportation path.

As further shown in the exemplary embodiment of FIG. 14, the upper element 1402 may be sized (e.g., formed and/or shape) to be approximately the same length of the lower element 1401 (in a longitudinal or transportation direction). Thus, as shown in the modular structure 1400 of FIG. 14, the lower element 1401 is configured to accommodate one upper element 1402, which may be connected (e.g., welded and/or fastened) to the lower element 1401. As shown in FIG. 14, the upper element 1402 may include one or more circumferential ribs 1410 (e.g., two ribs 1410) to provide increased structural integrity and stiffness to the upper element 1402. In embodiments, the ribs 1410 may be welded to the upper element after the upper element 1402 is formed and attached to the lower element 1401. Additionally, in embodiments, the ribs 1410 may also be attached to the lower element 1401 (e.g., fastened and/or welded to the lower element 1401).

As shown in FIG. 14, the lower element 1401 includes a planar middle portion 1450 and two wing portions 1455. With this exemplary and non-limiting embodiment, the wing portions 1455 have a tapered thickness. As shown in FIG. 14, the wing portions 1455 are tapered such that the gap separation between the first shell 1421 and second shell 1422 is varied along a length of the wing portions 1455. As shown in FIG. 14, with embodiments including the wing portions 1455 having a tapered thickness, a region may be provided on the support elements 1420 on top of the wing portions 1455 of the second shell for a second set of tracks (e.g., guidance tracks).

As further shown in FIG. 14, with this exemplary embodiment, the lower element 1401 includes framing members 1405 between the first shell 1421 and second shell 1422 in both the planar middle portion 1450 and two wing portions 1455. In embodiments, the framing members 1405 may be attached to (e.g., welded to) the first shell 1421 and/or the second shell 1422. In embodiments, the framing members 1405 may be structured and arranged to provide structural strength, support and/or redundancy to the lower element 1401. Additionally, in embodiments, the framing members 1405 may be used to properly space the first shell 1421 and the second shell 1422 during formation of the lower element 1402. In some contemplated embodiments, the framing members 1405 may be utilized in lieu of (or in addition to) the above-described filler materials to form the support elements 1415, 1420.

Figure 15:
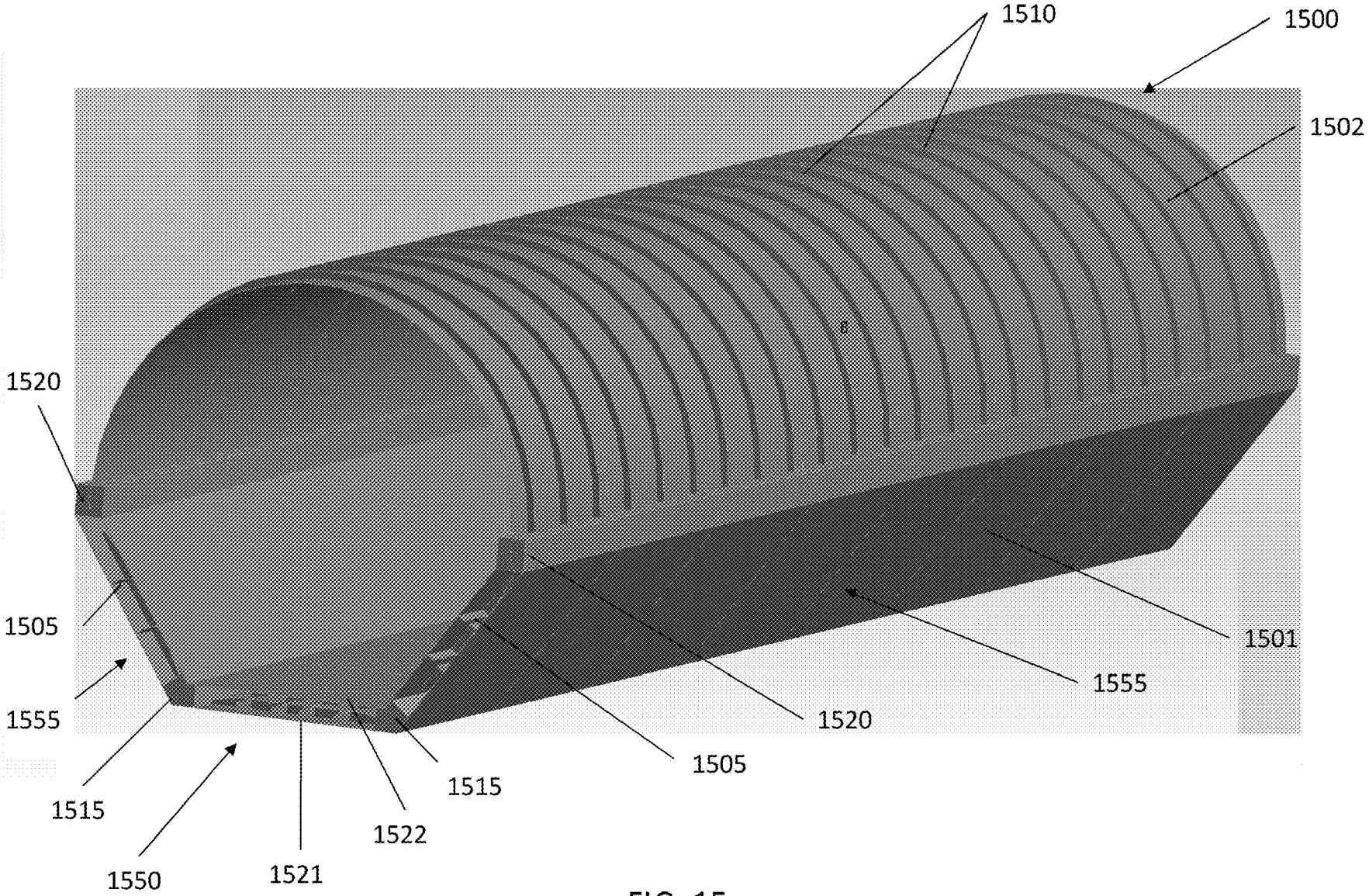
FIG. 15 shows an exemplary structure of combined modular structures in accordance with aspects of the disclosure.

FIG. 15 shows an exemplary modular structure 1500 in accordance with aspects of the disclosure. As shown in FIG. 15, the modular structure 1500 may include a lower element 1501 and one an upper element 1502. With the exemplary modular structure 1500, this may be a single lower element 1501 and a single upper element 1502, or a plurality of respective lower elements 1501 and upper elements 1502 connected together to form the modular structure 1500 having a length (e.g., a span length). In a contemplated exemplary embodiment, a span length may be approximately 40 meters. As shown in FIG. 15, ends of the upper element 1502 may be inserted into grooves of the support elements 1520 of the lower element 1501 and secured thereto (e.g., using welding, fasteners, and/or seals) to form the modular structure 1500. In accordance with aspects of the disclosure, a plurality of modular structures 1500 may be connected end-to-end to form the transportation path.

As further shown in the exemplary embodiment of FIG. 15, the upper element 1502 may be sized (e.g., formed and/or shape) to be approximately the same length of the lower element 1501 (in a longitudinal or transportation direction). Thus, as shown in the modular structure 1500 of FIG. 15, the lower element 1501 is configured to accommodate one upper element 1502, which may be connected (e.g., welded and/or fastened) to the lower element 1501. As shown in FIG. 15, the upper element 1502 may include one or more circumferential ribs 1510 to provide increased structural integrity to the upper element 1502. In embodiments, the ribs (e.g., external weldments or stiffeners) 1510 may be welded to the upper element after the upper element 1502 is formed and attached to the lower element 1501. Additionally, in embodiments, the ribs 1510 may also be attached to the lower element 1501 (e.g., fastened and/or welded to the lower element 1501).

As shown in FIG. 15, the lower element 1501 includes a planar middle portion 1550 and two wing portions 1555. With this exemplary and non-limiting embodiment, the wing portions 1555 have a constant thickness. As shown in FIG. 15, the wing portions 1555 are not tapered such that the gap separation between the first shell 1521 and second shell 1522 is approximately constant along a length of the wing portions 1555.

As further shown in FIG. 15, with this exemplary embodiment, the lower element 1501 includes framing members 1505 between the first shell 1521 and second shell 1522 in both the planar middle portion 1550 and two wing portions 1555. In embodiments, the framing members 1505 may be attached to (e.g., welded to) the first shell 1521 and/or the second shell 1522. In embodiments, the framing members 1505 may be structured and arranged to provide structural strength, support and/or redundancy to the lower element 1501. Additionally, in embodiments, the framing members 1505 may be used to properly space the first shell 1521 and the second shell 1522 during formation of the lower element 1502.

The exemplary embodiment of FIG. 15, was used to study the structural performance of the modular structure 1500 under conditions including gravity (self-weight) loading, extreme wind speed (e.g., 96 mph) loading, and low pressure inside environment/atmospheric pressure outside environment (combined with gravity loading). The analysis used a span length of 40 meters (which may be a maximum economical length of construction), assumed a span is directly adjacent to fixity, and located 10 meters above the ground (e.g., to represent maximum expected wind pressure).

As performance criteria, in order to have a unified deflection criterion, the deflection was normalized to the length of the span. Thus, deflection per length (e.g., Δ/L) due to the above conditions was measured, using Von Misses stress state criterion. With respect to the gravity analysis, the absolute deflection under self-weight was ~5 mm, which corresponds to a Δ/L of ~1/8000, with a maximum stress of ~70 MPa. With respect to the wind analysis, the absolute deflection due to wind was ~6.5 mm, which corresponds to a Δ/L of ~1/6200, with a maximum stress of ~390 MPa. Under current standards for transportation systems, a maximum allowable deflection is 19 mm.

With respect to the pressure analysis, the absolute deflection under vacuum was ~70 mm for the outer shell and ~30 mm for the inner shell, which corresponds to a Δ/L of ~1/1300, with a maximum stress of ~400 MPa. In accordance with aspects of the disclosure, the outer shell is structured and arranged to permit deflection thereof without affecting (or without impeding) the deflection of the inner shell, which may deflect to a different extent.

Figure 16:
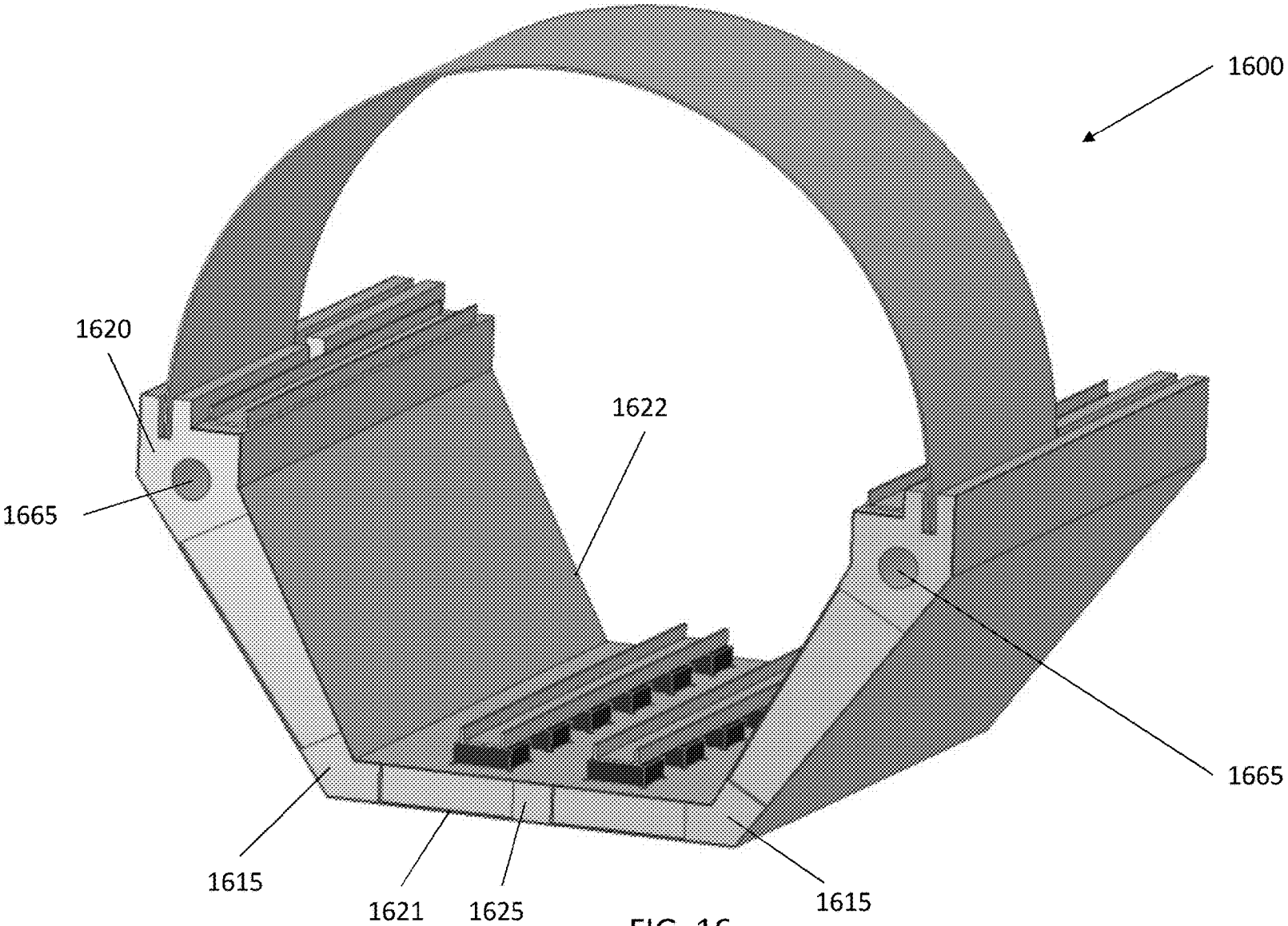
FIG. 16 shows an exemplary modular structure having conduits in accordance with aspects of the disclosure.

FIG. 16 shows an exemplary modular structure 1600 in accordance with aspects of the disclosure. As shown in FIG. 16, one or more through holes 1665 may be formed that traverse the support element 1620 from one side to the other. In embodiments, the hole 1665 may be formed by arranging a pipe or conduit structure relative to the first and second shells 1621, 1622 prior to forming the support elements 1620, and optionally removing the pipe or conduit structure prior to, e.g., concrete hardening, so as to form the through hole 1665. Once a plurality of modular structures 1600 are aligned relative to one another, one or more wires or cables (e.g., steel cable), for example, may be passed though the respective through holes 1665 and tensioned (e.g., post-tensioned) so as to secure the adjacent modular structures 1600 to one another.

In accordance with aspects of the disclosure, by utilizing post-tensioning with the modular structures, longer span lengths become more economically feasible. For example, utilizing post-tensioning reduces labor and material costs for the sub-structures. Additionally, post-tensioning allows developing positive camber in the spans prior to installation. Thus, in accordance with aspects of the disclosure, with post-tensioning it is possible to achieve a zero-deflection profile under self-weight. Additionally, post-tensioning with the modular structures increases stiffness and increases the frequency of the system.

In further contemplated embodiments, the one or more through holes 1665 may be used for accommodating communication cables, power cables, etc. While the exemplary discussed embodiment only describes through holes 1665 in support elements 1620, the disclosure contemplates that other support elements (e.g., support elements 1615 and/or 1625) may also include through holes 1665.

While the depicted exemplary embodiments include a modular structure for forming an enclosed transportation path, the disclosure contemplates a modular structure for forming two enclosed transportation paths (e.g., side-by-side). In such contemplated embodiments, the structure may additionally include a vertical center wall (or spaced vertical supports) arranged between a floor of the lower element to a peak of the upper element to provide structural stability and strength to the modular structure and to prevent deflection of the top of the upper element.

Figure 17B:
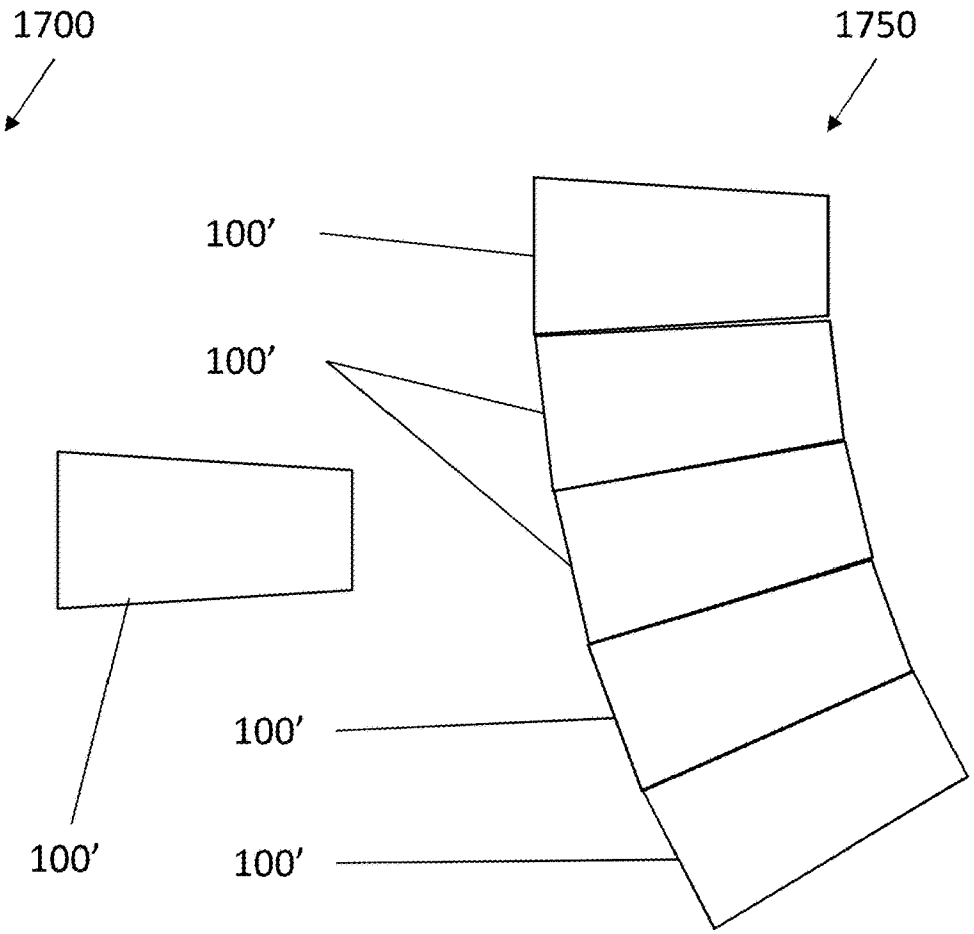
FIGS. 17A and 17B show an exemplary modular structures connected to form transportation paths in accordance with aspects of the disclosure.
Figure 17A:
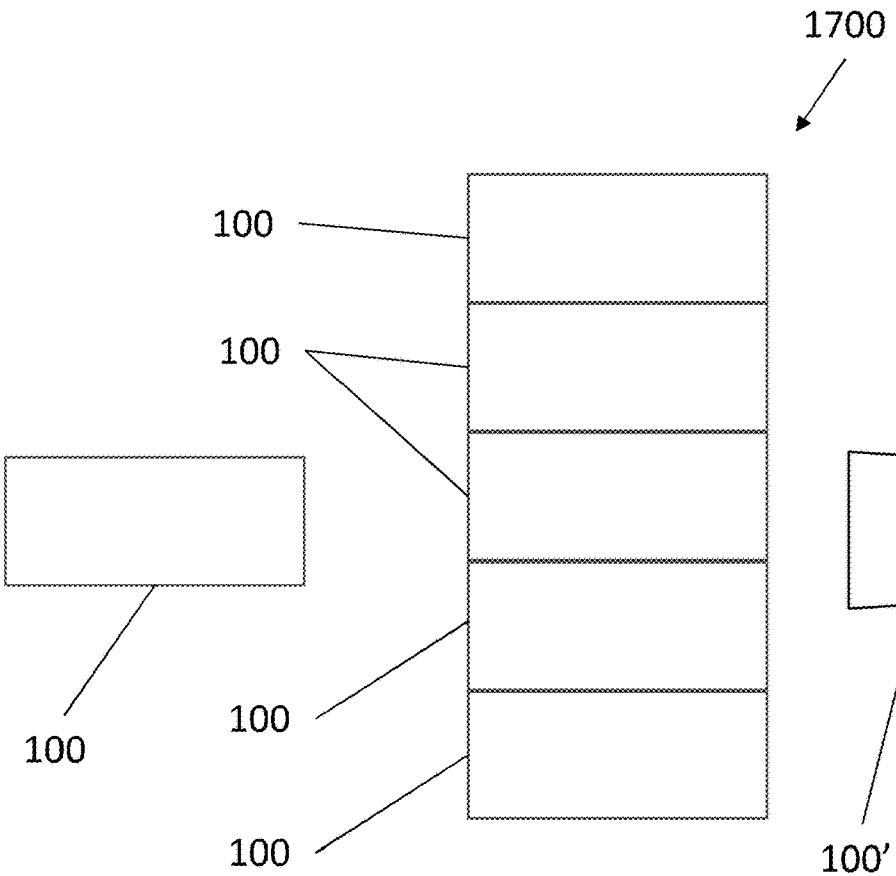

FIGS. 17A and 17B schematically depict overhead views (or side views) of exemplary modular structures connected together to form curved transportation paths in accordance with aspects of the disclosure.

In accordance with aspects of the disclosure, the modular structures are configured to be connected together to one another to form an enclosed transportation path structure for a transportation vehicle. The enclosed transportation path structure may maintain an environment different from that external to the enclosed modular structure. The enclosed modular structure, for example, may be capable of sustaining a temperature, a pressure, and/or any other condition or combination thereof, different from that of the environment external to the enclosed modular structure.

As shown in FIG. 17A, a modular structure 100 may be connected to modular structures 100 to form a form transportation path 1700. As shown in FIG. 17B, a modular structure 100' may be connected to modular structures 100' to form a form transportation path 1750. In accordance with aspects of the disclosure, by configuring some modular structures for portions of a turning path (e.g., with an overhead trapezoidal shape as schematically depicted in FIG. 17B), a plurality of these modular structures (e.g., modular structures 100') can be utilized to create a turning path (e.g., transportation path 1750). In contrast, modular structures for portions of a straight path (e.g., modular structure 100 with an overhead rectangular shape as schematically depicted in FIG. 17A), a plurality of these modular structures (e.g., modular structures 100) can be utilized to create a straight path (e.g., transportation path 1700). As should be understood, the modular structures of the present disclosure can be suitably configured to provide the desired turning radius of the transportation path, as exemplified in the non-limiting schematic depictions of FIGS. 17A and 17B.

Figure 18:
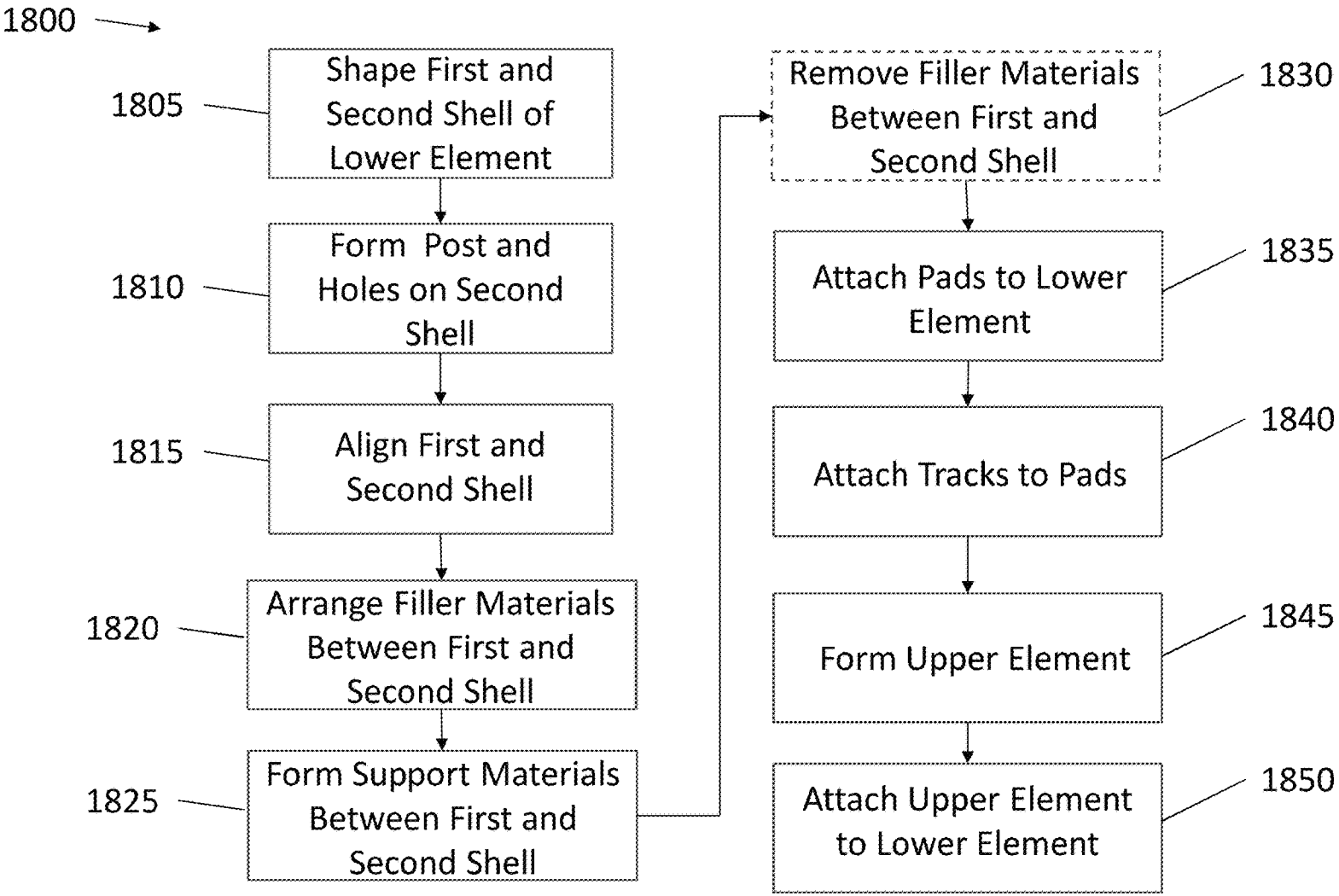
FIG. 18 shows an exemplary flow diagram for assembling a modular structure in accordance with aspects of the disclosure.

FIG. 18 shows an exemplary and non-limiting flow diagram 1800 for assembling an exemplary modular structure in accordance with aspects of the disclosure. As shown in FIG. 18, at step 1805, the first and the second shell element are shaped (for example from a flat plate as shown in FIG. 4 to the shells as shown in FIGS. 5 and 7). At step 1810, holes are formed in the second shell and posts (or frictional studs) are formed on the first shell and/or the second shell (for example, as depicted in FIGS. 5 and 6). At step 1815, the first and second shells are aligned relative to one another (for example, as shown in FIG. 7). At step 1820, the filler materials are arranged between the first and second shells (for example, as shown in FIG. 8). At step 1825, the support elements are formed between the first and second shells (for example, as shown in FIG. 9).

As shown in FIG. 18, at optional step 1830 (as indicated by the dashed line), the filler materials are removed from between the first and second shells (for example, as shown in FIG. 13). At step 1835, track support pads are attached to the lower element. At step 1840, tracks are attached to the pads. At step 1845, the upper element is formed (e.g., by bending a flat plate to an arc shape). At step 1850, the upper element is attached to the lower element (for example, as shown in FIG. 1).

Although embodiments of this disclosure have been fully described with reference to the accompanying drawings, it is to be noted that various changes and modifications will become apparent to those skilled in the art. Such changes and modifications are to be understood as being included within the scope of embodiments of this disclosure as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

Although the present specification describes components and functions that may be implemented in particular embodiments with reference to particular standards and protocols, the disclosure is not limited to such standards and protocols. Such standards are periodically superseded by faster or more efficient equivalents having essentially the same functions. Accordingly, replacement standards and protocols having the same or similar functions are considered equivalents thereof.

The illustrations of the embodiments described herein are intended to provide a general understanding of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

Accordingly, the present disclosure provides various systems, structures, methods, and apparatuses. Although the disclosure has been described with reference to several exemplary embodiments, it is understood that the words that have been used are words of description and illustration, rather than words of limitation. Changes may be made within the purview of the appended claims, as presently stated and as amended, without departing from the scope and spirit of the disclosure in its aspects. Although the disclosure has been described with reference to particular materials and embodiments, embodiments of the invention are not intended to be limited to the particulars disclosed; rather the invention extends to all functionally equivalent structures, methods, and uses such as are within the scope of the appended claims.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the embodiments of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

Thus, while the specification describes particular embodiments of the present disclosure, those of ordinary skill can devise variations of the present disclosure without departing from the inventive concept. For example, while discussed in context of high-speed, low-pressure transportation system, it should be understood that the disclosure contemplates that other transportation systems may utilize aspects of the loading/unloading processes and structures of the present disclosure. For example, the transportation system may include a high-speed transportation system (e.g., maglev (magnetic levitation) train) that does not utilize a low-pressure environment.

Insofar as the description above and the accompanying drawing disclose any additional subject matter that is not within the scope of the claims below, the embodiments are not dedicated to the public and the right to file one or more applications to claim such additional embodiments is reserved.

What is claimed is:

1. A modular structure, configured to be connectable with a plurality of modular structures to form an enclosed transportation path, each modular structure comprising:

a bottom element structured and arranged to provide a track support surface and a plurality of upper element attachment structures; and an upper element configured to attach to the bottom element at the plurality of upper element attachment structures, wherein the upper element is arranged to sealingly engage with the lower element, wherein the bottom element comprises:

a first shell structured and arranged to form an exterior wall of the bottom element; and a second shell structured and arranged to form an interior wall of the enclosed transportation path, and wherein the first shell, the second shell and the upper element each are formed from a planar sheet of metal.

2. The modular structure according to claim 1, wherein the second shell is spaced from the first shell to provide a gap between the first shell and the second shell.

3. The modular structure according to claim 2, wherein the bottom element comprises a horizontal portion structured and arranged to provide the track support surface, and two wing portions that respectively project upwardly and outwardly from the horizontal portion.

4. The modular structure according to claim 3, wherein the upper element attachment structures are respectively arranged on the two wing portions.

5. The modular structure according to claim 3, wherein the gap is constant in the horizontal portion and constant the wing portions.

6. The modular structure according to claim 3, wherein the gap is constant in the horizontal portion and varying in the wing portions.

7. The modular structure according to claim 2, further comprising:

at least one support material arranged in the gap to secure the first shell to the second shell.

8. The modular structure according to claim 7, wherein the at least one support material arranged in the gap comprises at least two support materials in the gap, and wherein two of the at least two support materials are configured to each provide respective upper element attachment structures.

9. The modular structure according to claim 8, wherein the respective upper element attachment structures comprise a receiving groove in each of the two of the at least two support materials, wherein the receiving grooves are sized to accommodate respective ends of the upper element in a sealingly-engaged manner.

10. The modular structure according to claim 8, wherein the bottom element comprises a horizontal portion structured and arranged to provide the track support surface, and two wing portions that respectively project upwardly and outwardly from the horizontal portion, and wherein the at least one support material additionally comprises at least two support materials formed in the gap at the respective transitions from the horizontal portion to the two wing portions.

11. The modular structure according to claim 7, further comprising:

at least one filler material arranged in the gap to define areas for forming the at least one support material.

12. The modular structure according to claim 7, wherein at least one of the first shell and the second shell includes a plurality of posts projecting therefrom and structured and arranged to contact the support material to strengthen a connection between the support material and the first and second shells.

13. The modular structure according to claim 7, wherein the second shell includes a plurality holes formed therein that are structured and arranged for connecting track supports and/or track elements to the second shell.

14. The modular structure of claim 7, wherein the support material comprises concrete.

15. The modular structure according to claim 1, further comprising a transportation track arranged on the bottom element.

16. The modular structure of claim 1, the lower element further comprising:

at least one connection projection projecting from the lower element in a transportation direction; and at least one receiving hole configured to receive a corresponding projection from an adjacently arranged modular structure, wherein the at least one connection projection and the at least one receiving hole permit the modular structure and the adjacently arranged modular structure to connect in an aligned manner.

17. The modular structure of claim 1, the lower element further comprising:

at least one through hole projecting in a transportation direction through a support material formed in the lower element, wherein the at least one through hole is structured and arranged to receive a tensioning cable so as to connect the modular structure and an adjacently arranged modular structure in an aligned manner.

18. A method of forming an enclosed transportation path comprising a plurality of modular structures according to claim 1, the method comprising:

forming respective bottom elements at a first location;

transporting the respective bottom elements from the first location to a job-site location;

installing and connecting the respective bottom elements to form a transportation path structure;

installing and/or connecting track segments of the respective bottom elements to form a transportation track; and attaching respective upper elements to respective bottom elements of the transportation path structure at the job-site location to form the enclosed transportation path.

19. The method according to claim 18, wherein the installing the track segments of the respective bottom elements is performed prior to the transporting the respective bottom elements from the first location to the job-site location.

20. The method according to claim 18, wherein the transporting the respective bottom elements from the first location to a job-site location comprises transporting the respective bottom elements in a nested manner.

21. A modular structure, configured to be connectable with a plurality of modular structures to form an enclosed transportation path, each modular structure comprising:

a bottom element structured and arranged to provide a track support surface and a plurality of upper element attachment structures; and an upper element configured to attach to the bottom element at the plurality of upper element attachment structures, wherein the upper element is arranged to sealingly engage with the lower element, wherein the bottom element comprises:

a first shell structured and arranged to form an exterior wall of the bottom element; and a second shell structured and arranged to form an interior wall of the enclosed transportation path, wherein the second shell is spaced from the first shell to provide a gap between the first shell and the second shell, further comprising secondary tracks arranged the second shell adjacent the upper element attachment structures.

22. A method of forming a modular structure, the method comprising:

forming a bottom element structured and arranged to provide a track support surface and to provide a plurality of upper element attachment structures; and forming an upper element structured to attach to the bottom element at the plurality of upper element attachment structures, wherein the upper element is configured to sealingly engage with the lower element, wherein forming the bottom element comprises:

shaping a first shell and a second shell;

arranging the first shell relative to the second shell with a gap there between;

arranging at least one filler material in the gap to define at least one space for arranging at least one support material;

supplying the at least one support material into the at least one space; and hardening the support material to form at least one support element in the gap that securely connects the first shell to the second shell, wherein the first shell, the second shell and the upper element each are formed from a planar sheet of metal.

23. The method of forming a modular structure of claim 22, the method further comprising removing the at least one filler material from the gap subsequent to the hardening.

24. The method of forming a modular structure of claim 22, further comprising attaching track elements to the bottom element.

* * * * *